US011668069B2

(12) United States Patent
Ishihara et al.

(10) Patent No.: US 11,668,069 B2
(45) Date of Patent: Jun. 6, 2023

(54) CONSTRUCTION MACHINE

(71) Applicant: HITACHI CONSTRUCTION MACHINERY CO., LTD., Tokyo (JP)

(72) Inventors: Shinji Ishihara, Tokyo (JP); Hiroshi Sakamoto, Tsuchiura (JP); Hidekazu Moriki, Tokyo (JP); Ryu Narikawa, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 499 days.

(21) Appl. No.: 16/760,530

(22) PCT Filed: Nov. 8, 2018

(86) PCT No.: PCT/JP2018/041499
§ 371 (c)(1),
(2) Date: Apr. 30, 2020

(87) PCT Pub. No.: WO2019/093424
PCT Pub. Date: May 16, 2019

(65) Prior Publication Data

US 2021/0040705 A1 Feb. 11, 2021

(30) Foreign Application Priority Data

Nov. 13, 2017 (JP) ..... JP2017-218071

(51) Int. Cl.
*E02F 3/43* (2006.01)
*E02D 3/046* (2006.01)
*E02F 9/22* (2006.01)

(52) U.S. Cl.
CPC ..... *E02F 3/435* (2013.01); *E02D 3/046* (2013.01); *E02F 9/2203* (2013.01)

(58) Field of Classification Search
CPC ..... E02F 3/32; E02F 9/2033; E02F 9/2203; E02F 3/435; E02D 3/046
See application file for complete search history.

(56) References Cited

U.S. PATENT DOCUMENTS 5,735,065 A * 4/1998 Yamagata ..... E02F 3/437 701/50
11,001,985 B2 * 5/2021 Ito ..... E02F 9/2033
(Continued)

FOREIGN PATENT DOCUMENTS

JP 2007-9432 A 1/2007
JP 2012-112108 A 6/2012
(Continued)

OTHER PUBLICATIONS

International Preliminary Report on Patentability received in corresponding International Application No. PCT/JP2018/041499 dated May 28, 2020.
(Continued)

*Primary Examiner* — Abiy Teka
(74) *Attorney, Agent, or Firm* — Mattingly & Malur, PC

(57) ABSTRACT

A construction machine that can make a depressing force of a bucket during compaction work to be uniform without requiring an operator to perform a complicated operation is provided. A controller 18 determines whether or not compaction work is in progress, calculates a front distance R that represents a distance between a rotational pivot of a boom 4 and a predetermined position B in a back surface of a bucket 6, determines a target velocity of the bucket such that a velocity with which the bucket approaches a leveling target surface decreases with increasing values of the front distance, and, during the compaction work, notifies the operator of details of an operation of operation devices 9*a* and 9*b* for achieving the target velocity of the bucket or controls
(Continued)

hydraulic actuators 4*a* to 6*a* so as to achieve the target velocity of the bucket.

4 Claims, 18 Drawing Sheets

(56) References Cited

U.S. PATENT DOCUMENTS

| | | | | |
|---|---|---|---|---|
| 2017/0268204 | A1* | 9/2017 | Shimano | E02F 3/435 |
| 2019/0249391 | A1 | 8/2019 | Kikuchi et al. | |

FOREIGN PATENT DOCUMENTS

| | | | |
|---|---|---|---|
| JP | 2012-225084 | A | 11/2012 |
| JP | 2017-166308 | A | 9/2017 |
| WO | 2016/125916 | A1 | 8/2016 |
| WO | 2018/179577 | A1 | 10/2018 |

OTHER PUBLICATIONS

International Search Report PCT/JP2018/041499 dated Dec. 25, 2018.

* cited by examiner

CONSTRUCTION MACHINE

TECHNICAL FIELD

The present invention relates to a construction machine such as a hydraulic excavator.

BACKGROUND ART

In recent years, to respond to a need for computerized work, there are some construction machines including hydraulic excavators have a function of machine guidance, by which a position or posture of a work mechanism, such as a boom, an arm, and a bucket, is displayed for an operator and a function of machine control, by which the position of the work mechanism is controlled such that the work mechanism moves along a target work surface. Known techniques representing the foregoing functions include one displaying a bucket distal end position and a bucket angle of the hydraulic excavator on a display and one limiting movement of the bucket distal end as the bucket distal end approaches the target work surface so as not to allow the bucket distal end to advance further.

In construction work, compaction work (also known as "bumping work") is performed as a finishing step following leveling work, in which the ground is compacted by a bucket back surface bumping against the ground. Known techniques supporting the compaction work are disclosed in, for example, Patent Documents 1 and 2.

Patent Document 1 discloses a technique, in which control is changed between the leveling work and the compaction work on the basis of an operation signal from an operation member (e.g., an operation lever) for operating a work implement and, during the compaction work, a velocity of the work implement advancing toward the design terrain profile is limited according to a distance between the work implement and the design terrain profile.

Patent Document 2 discloses a technique, in which a reach of a front work implement is detected and control to vary a pump flow rate or an opening angle of a control valve is performed according to the magnitude of the reach, to thereby make constant a relation between a lever operation amount and a bucket (attachment) movement regardless of changes in the reach.

PRIOR ART DOCUMENT

Patent Documents

Patent Document 1: WO2016/125916
Patent Document 2: JP-2012-225084-A

SUMMARY OF THE INVENTION

Problem to be Solved by the Invention

In the compaction work, strength (depressing force) with which the bucket back surface is bumped against the ground is a factor determining a level of workmanship of a finished surface. This is because variations in the depressing force exerted by the bucket back surface result in irregularities on the finished surface. Thus, to produce a finished surface with high quality, how to maintain a uniform depressing force is a major challenge to be addressed. The depressing force is defined as a product of the bucket velocity and inertia of the front work implement (front inertia) and the front inertia varies according to posture of the front work implement.

Against the foregoing background, with the technique disclosed in Patent Document 1, although the bucket velocity is limited to a constant level or lower depending on the distance between the work implement and the design terrain profile during the compaction work, the front inertia is varied with the posture of the front work implement, resulting in the depressing force fluctuating. With the technique disclosed in Patent Document 2, while the bucket velocity with respect to the boom operation amount remains constant regardless of the reach of the front work implement, the operator needs to adjust the boom operation amount according to the posture of the front work implement in order to make the depressing force uniform, and a high level of expertise is, therefore, required to make the depressing force uniform.

The present invention has been made in view of the foregoing situation and it is an object of the present invention to provide a construction machine that can make a depressing force of a bucket uniform during compaction work without requesting an operator to perform a complicated operation.

Means for Solving the Problem

To achieve the foregoing object, an aspect of the present invention provides a construction machine that includes: a machine body; an articulated front work implement disposed anterior to the machine body and including a boom, an arm, and a bucket; a plurality of hydraulic actuators including a boom cylinder that drives the boom, an arm cylinder that drives the arm, and a bucket cylinder that drives the bucket; an operation device that is operated by an operator to instruct an operation of each of the boom, the arm, and the bucket; a boom posture sensor that senses posture of the boom; an arm posture sensor that senses posture of the arm; a bucket posture sensor that senses posture of the bucket; and a controller that controls drive of the hydraulic actuators in response to an operation of the operation device, the controller setting a leveling target surface, determining target velocities of the boom, the arm, and the bucket such that the bucket does not advance further down the leveling target surface, and, during leveling work, notifying the operator of details of an operation of the operation device for achieving the target velocities of the arm and the bucket or controlling drive of the hydraulic actuators so as to achieve the target velocities of the arm and the bucket. In the construction machine, the controller determines whether or not compaction work is in progress, calculates a front distance that represents a distance between a rotational pivot of the boom and a predetermined position in a back surface of the bucket, determines the target velocity of the bucket such that a velocity with which the bucket approaches the leveling target surface decreases with increasing values of the front distance, and, during the compaction work, notifies the operator of details of an operation of the operation device, the details being used for achieving the target velocity of the bucket, or controls drive of the hydraulic actuators so as to achieve the target velocity of the bucket.

In accordance with the aspect of the present invention having configurations as described above, during the compaction work, the target velocity of the bucket is determined such that the velocity with which the bucket approaches the leveling target surface decreases with increasing values of the front distance and the operator is notified of details of the operation of the operation device for achieving the target velocity of the bucket or the hydraulic actuators are controlled so as to achieve the target velocity of the bucket. The operator thereby can make the depressing force of the bucket uniform during the compaction work without the need to perform a complicated operation.

Advantages of the Invention

The present invention enables the depressing force of the bucket to be uniform during the compaction work without requesting the operator to perform a complicated operation.

MODES FOR CARRYING OUT THE INVENTION

Figure 1:
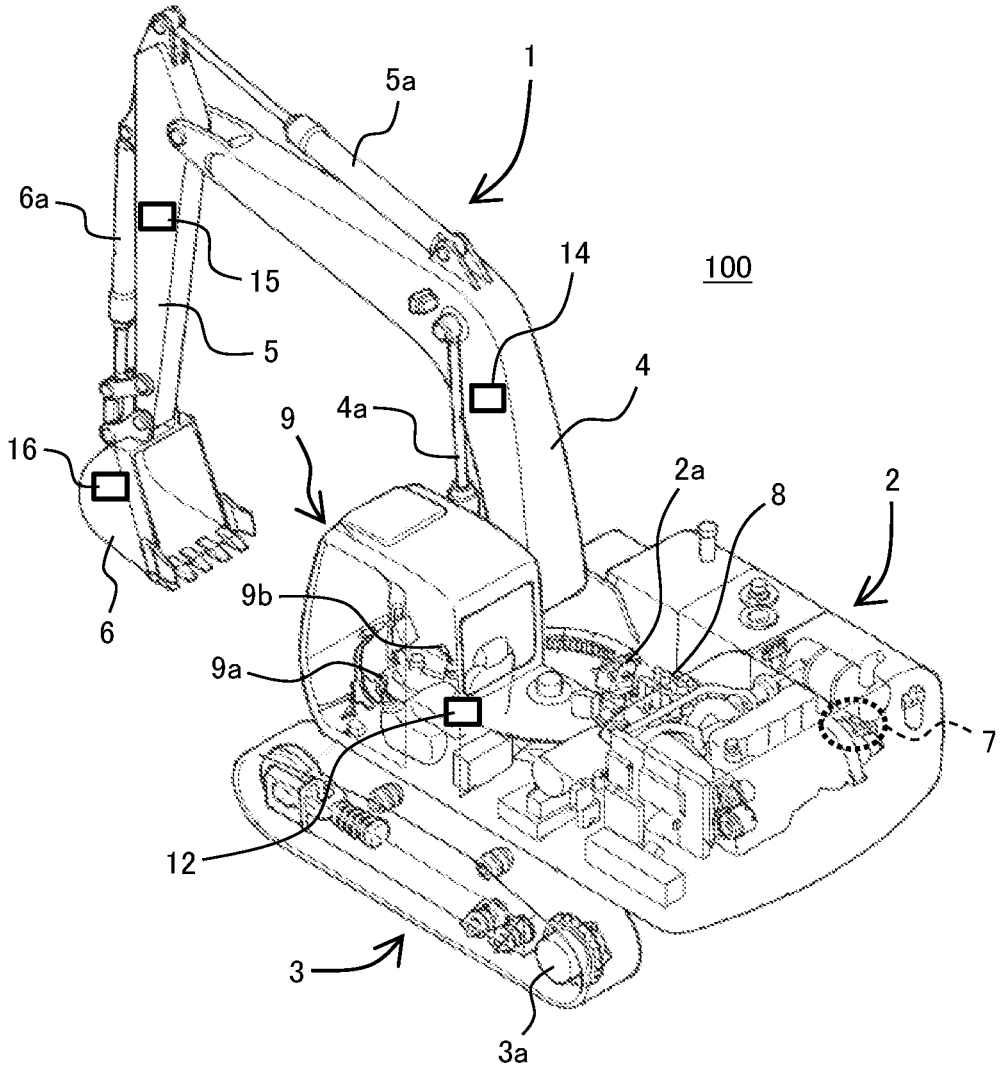
FIG. 1 is an illustration schematically illustrating an appearance of a hydraulic excavator according to an embodiment of the present invention.

Embodiments of the present invention will be described below with reference to the accompanying drawings and using a hydraulic excavator including, as a work device, a bucket at a distal end of a front implement (front work implement), as a construction machine according to the embodiments of the present invention. In the drawings, like or corresponding parts are identified by identical reference characters and descriptions for those parts will be omitted as appropriate.

FIG. 1 is an illustration schematically illustrating an appearance of a hydraulic excavator according to an embodiment of the present invention.

In FIG. 1, the hydraulic excavator 100 includes an articulated front implement (front work implement) 1 and, an upper swing structure 2 and a lower track structure 3, which constitute a machine body. The front work implement 1 connects together a plurality of driven members (a boom 4, an arm 5, and a bucket (work device) 6) that each rotate in a vertical direction. The upper swing structure 2 is swingable with respect to the lower track structure 3. The boom 4, as one front work implement 1, has a proximal end supported rotatably in the vertical direction at a front portion of the upper swing structure 2. The arm 5 has one end supported rotatably in the vertical direction at an end portion (distal end) different from the proximal end of the boom 4. The bucket 6 is supported rotatably in the vertical direction by another end of the arm 5. The boom 4, the arm 5, the bucket 6, the upper swing structure 2, and the lower track structure 3 are driven by a boom cylinder 4*a*, an arm cylinder 5*a*, a bucket cylinder 6*a*, a swing motor 2*a*, and left and right track motors 3*a* (only the track motor on one side is depicted), respectively, as hydraulic actuators.

The boom 4, the arm 5, and the bucket 6 operate on a single plane (hereinafter referred to as an operating plane). The operating plane is orthogonal to a rotational axis of each of the boom 4, the arm 5, and the bucket 6. The operating plane can be set so as to pass through a center in a width direction of the boom 4, the arm 5, and the bucket 6.

A cab 9, in which an operator rides, is provided with left and right operation lever devices (operation devices) 9*a* and 9*b*, which output operation signals for operating the hydraulic actuators 2*a* to 6*a*. The left and right operation lever devices 9*a* and 9*b* each include an operation lever and a sensor. The operation lever can be tilted in a fore-aft direction and a left-right direction. The sensor electrically senses an operation signal that corresponds to an inclination amount of the operation lever (lever operation amount). The left and right operation lever devices 9*a* and 9*b* each output the lever operation amount sensed by the sensor to a controller 18 (depicted in FIG. 2) via an electric wire. Specifically, operations of the hydraulic actuators 2*a* to 6*a* are assigned to the respective fore-aft and left-right directions of the respective operation levers of the left and right operation lever devices 9*a* and 9*b*.

Operation control for the boom cylinder 4*a*, the arm cylinder 5*a*, the bucket cylinder 6*a*, the swing motor 2*a*, and the left and right track motors 3*a* is performed through control with a control valve 8 of directions and flow rates of hydraulic fluid to be supplied to the respective hydraulic actuators 2*a* to 6*a* from a hydraulic pump unit 7, which is driven by a prime mover such as an engine and an electric motor not depicted. The control of the control valve 8 is performed through a drive signal (pilot pressure) output from a pilot pump not depicted via a solenoid proportional valve. The solenoid proportional valve is controlled by the controller 18 on the basis of the operation signal from the left and right operation lever devices 9*a* and 9*b*. The operation of each of the hydraulic actuators 2*a* to 6*a* is thereby controlled.

It is noted that the left and right operation lever devices 9*a* and 9*b* may be operated as a hydraulic pilot operated system and a pilot pressure corresponding to a direction in which, and an amount over which, the operation lever is operated by the operator is supplied as a drive signal to the control valve 8 to thereby drive the corresponding one of the hydraulic actuators 2*a* to 6*a*.

IMUs (Inertial Measurement Units) 12 and 14 to 16, as posture sensors, are disposed in the upper swing structure 2, the boom 4, the arm 5, and the bucket 6, respectively. The inertial measurement units may, in the following, be referred to specifically as a machine body inertial measurement unit 12, a boom inertial measurement unit 14, an arm inertial measurement unit 15, and a bucket inertial measurement unit 16, when one is to be differentiated from another.

The inertial measurement units 12 and 14 to 16 measure angular velocity and acceleration. Consider a condition in which the upper swing structure 2, and the driven members 4 to 6, in which the inertial measurement units 12 and 14 to 16 are disposed, are stationary. An orientation (posture: posture angle θ to be described later) of each of the upper swing structure 2, and the driven members 4 to 6 can be sensed on the basis of a direction of gravitational acceleration (specifically, a vertical downward direction) in an IMU coordinate system set for each of the inertial measurement units 12 and 14 to 16 and a mounting condition of each of the inertial measurement units 12 and 14 to 16 (specifically, positional relations of the inertial measurement units 12 and 14 to 16 relative to the upper swing structure 2, and the driven members 4 to 6, respectively). It is here noted that the boom inertial measurement unit 14 constitutes a boom posture sensor that senses information on the posture of the boom 4 (hereinafter referred to as posture information), the arm inertial measurement unit 15 constitutes an arm posture sensor that senses posture information of the arm 5, and the bucket inertial measurement unit 16 constitutes a bucket posture sensor that senses posture information of the bucket 6.

It is noted that the posture information sensor is not limited to the inertial measurement unit and an inclination angle sensor may, for example, be used. Alternatively, a potentiometer may be disposed at a connection portion of each of the driven members 4 to 6 and relative orientations (posture information) of the upper swing structure 2 and each of the driven members 4 to 6 are sensed. The posture of each of the driven members 4 to 6 may then be found from sensing results. Alternatively, a stroke sensor may be disposed in each of the boom cylinder 4*a*, the arm cylinder 5*a*, and the bucket cylinder 6*a*. The relative orientation (posture information) in each connection portion of the upper swing structure 2, and the driven members 4 to 6 is then calculated from a stroke change amount and the posture of each of the driven members 4 to 6 (posture angle θ) is found from calculation results.

Figure 2:
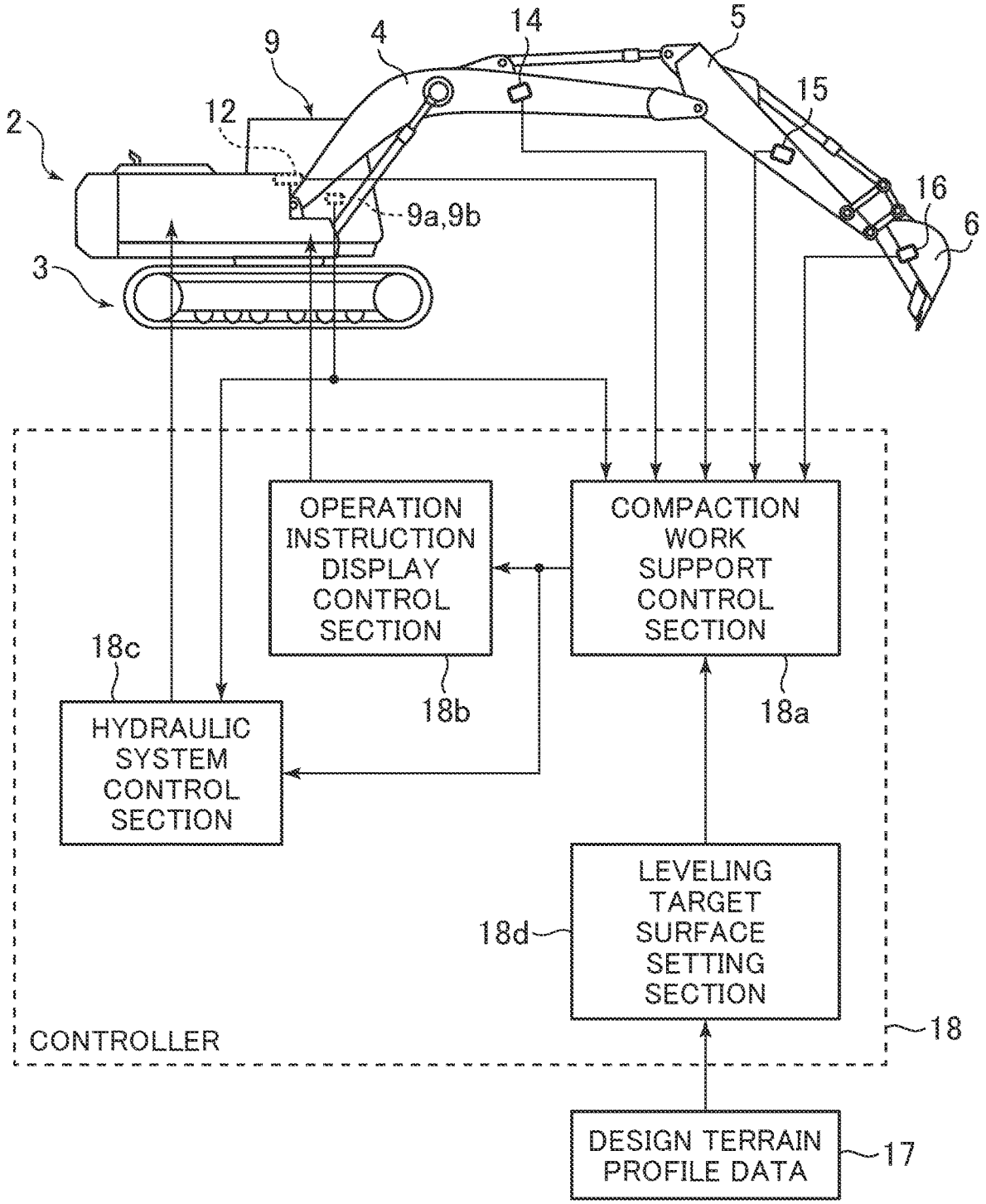
FIG. 2 is a functional block diagram schematically depicting a part of processing functions performed by a controller according to the embodiment of the present invention.

FIG. 2 schematically depicts a part of processing functions performed by a controller mounted in the hydraulic excavator 100.

In FIG. 2, the controller 18 has various functions for controlling operations of the hydraulic excavator 100. The controller 18 includes, as parts of functional sections thereof, a compaction work support control section 18*a*, an operation instruction display control section 18*b*, a hydraulic system control section 18*c*, and a leveling target surface setting section 18*d*.

The compaction work support control section 18*a* calculates, on the basis of the sensing results from the inertial measurement units 12 and 14 to 16 and an input from the leveling target surface setting section 18*d* (to be described later), a front distance (reach) that represents a distance between a boom foot pin as a rotational center for the boom 4 and a predetermined position in a back surface of the bucket 6 and a bucket position in a machine body coordinate system. Additionally, a target velocity of the bucket 6 for compaction work is calculated on the basis of machine body information including the front distance and the bucket position. Detailed calculations will be described later.

The operation instruction display control section 18*b* controls display on a monitor not depicted disposed in the cab 9 and voice of a speaker not depicted. On the basis of the posture information of the front work implement 1 and the bucket target velocity which are calculated by the compaction work support control section 18*a*, the operation instruction display control section 18*b* calculates instruction details for operation support to be given to the operator and displays the instructions on the monitor in the cab 9 or notifies the operator of the instructions by voice.

Specifically, the operation instruction display control section 18*b* performs parts of functions as a machine guidance system that aids the operator in performing operations by, for example, displaying on the monitor the posture of the front work implement 1, which includes the driven members including the boom 4, the arm 5, and the bucket 6, and the distal end position, angle, and velocity of the bucket 6.

The hydraulic system control section 18*c* controls a hydraulic system of the hydraulic excavator 100, including the hydraulic pump unit 7, the control valve 8, and the hydraulic actuators 2*a* to 6*a*. On the basis of the posture information of the front work implement 1 and the bucket target velocity which are calculated by the compaction work support control section 18*a*, the hydraulic system control section 18*c* calculates an operation of the front work implement 1 and controls the hydraulic system of the hydraulic excavator 100 so as to achieve the operation. Specifically, the hydraulic system control section 18*c* performs parts of functions as a machine control system that controls to limit the operation of the front work implement 1 so as not, for example, to allow the back surface of the bucket 6 to hit against the leveling target surface with an excessive force or to allow any part of the bucket 6 other than the back surface to contact the leveling target surface.

The leveling target surface setting section 18*d* calculates a leveling target surface that defines a target geometry of an object to be leveled on the basis of design terrain profile data 17, which includes three-dimensional work drawings previously stored by a construction administrator in a storage device not depicted.

First Embodiment

The hydraulic excavator 100 according to a first embodiment of the present invention will be described with reference to FIGS. 3 to 7.

Figure 3:
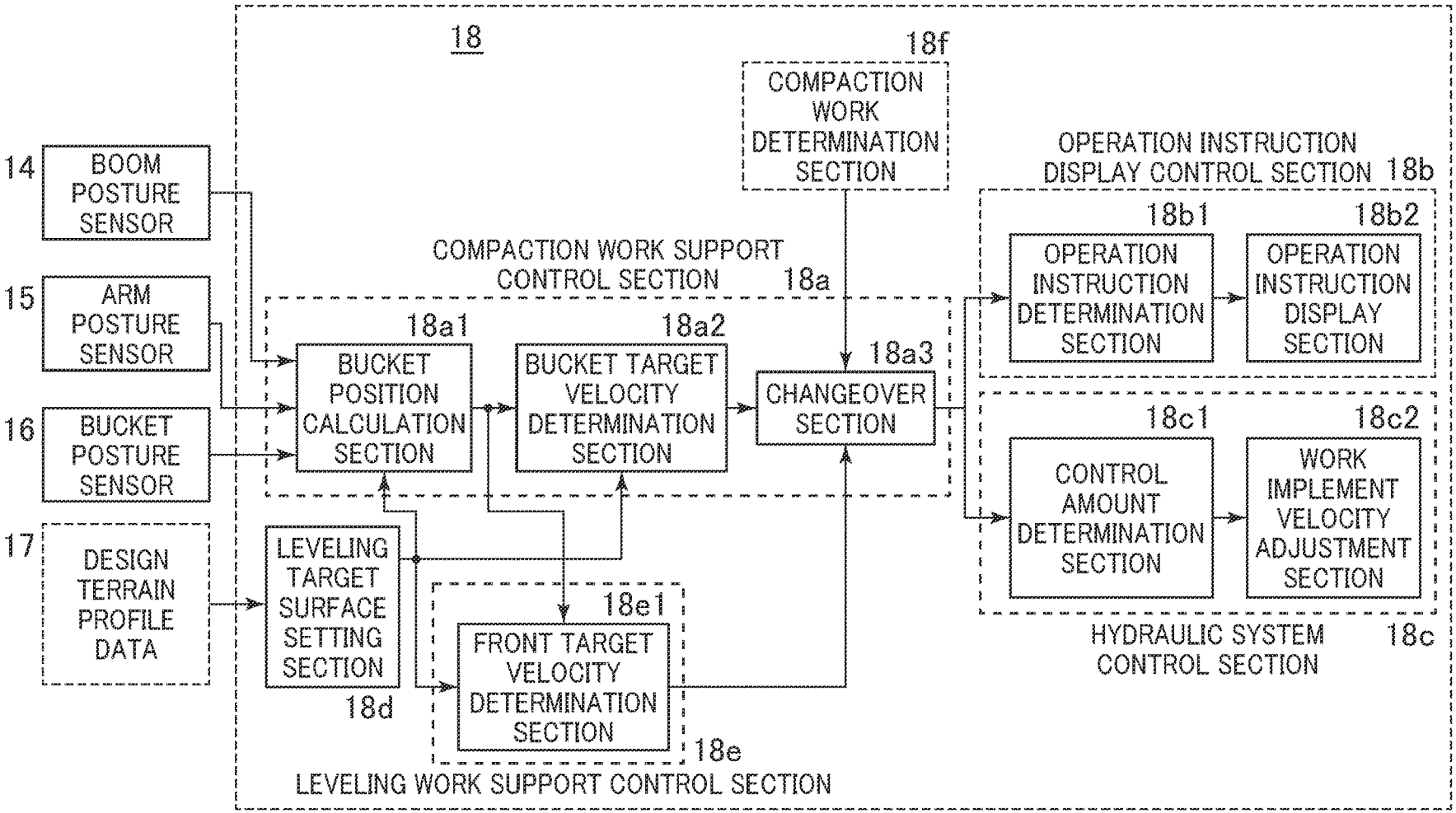
FIG. 3 is a detailed functional block diagram of a controller according to a first embodiment.

FIG. 3 is a detailed functional block diagram of the controller 18 according to the present embodiment. It is noted that FIG. 3 omits functions not directly related to the present invention, as with FIG. 2.

In FIG. 3, the compaction work support control section 18*a* includes a bucket position calculation section 18*a*1, a bucket target velocity determination section 18*a*2, and a control changeover section 18*a*3.

The bucket position calculation section 18*a*1 calculates coordinates of the predetermined position in the back surface of the bucket 6 and the front distance (reach) to correspond to the output from each of the posture sensors of the boom 4, the arm 5, and the bucket 6 (specifically, each of the inertial measurement units 14 to 16).

A method for calculating the predetermined position in the back surface of the bucket 6 and the front distance will be described with reference to FIG. 4.

The bucket position calculation section 18*a*1 calculates the coordinates of a predetermined position B in the back surface of the bucket 6 using a position O of the boom foot pin as a rotational pivot of the boom 4 as a coordinate origin. It is noted that the predetermined position B in the back surface may be set at any position on the bucket back surface in contact with the leveling target surface during the compaction work.

Let a boom length Lbm denote a distance between the position O of the boom foot pin and a rotational pivot of the arm 5 (a connection portion between the boom 4 and the arm 5), let an arm length Lam denote a distance between the rotational pivot of the arm 5 and a rotational pivot of the bucket 6 (a connection portion between the arm 5 and the bucket 6), and let a bucket length Lbk denote a distance between the rotational pivot of the bucket 6 and the predetermined position B in the back surface of the bucket 6. Then, coordinate values (x, y) in a front coordinate system of the predetermined position B in the back surface of the bucket 6 can be obtained with expressions (1) and (2) given below, where θbm, θam, and θbk denote angles (posture angles) of the boom 4, the arm 5, and the bucket 6 (to be more precise, orientations of the boom length Lbm, the arm length Lam, and the bucket length Lbk) relative to a horizontal direction, respectively.

[Expression 1]

$$X=L_{bm}\cos\theta_{bm}+L_{am}\cos\theta_{am}+L_{bk}\cos\theta_{bk} \quad (1)$$

[Expression 2]

$$y=L_{bm}\sin\theta_{bm}+L_{am}\sin\theta_{am}+L_{bk}\sin\theta_{bk} \quad (2)$$

A front distance R represents a distance between the position O of the boom foot pin and the predetermined position B in the back surface of the bucket 6 and can be obtained with expression (3) given below.

[Expression 3]

$$R=\sqrt{x^2+y^2} \quad (3)$$

Figure 4:
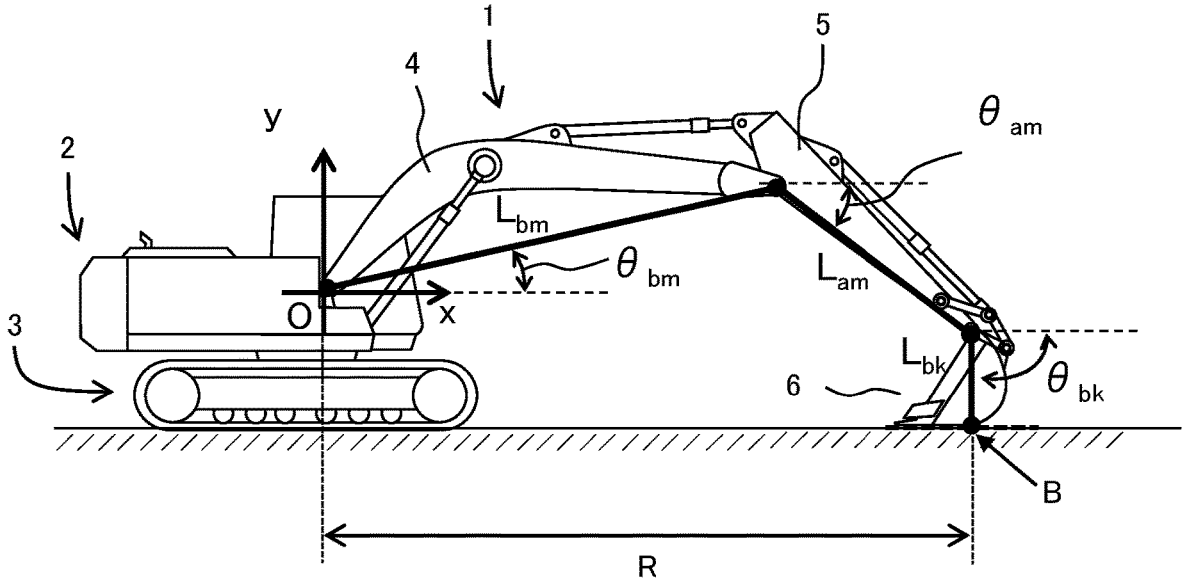
FIG. 4 is a diagram illustrating a method for calculating a predetermined position of a back surface of a bucket and a front distance (reach).
Figure 5:
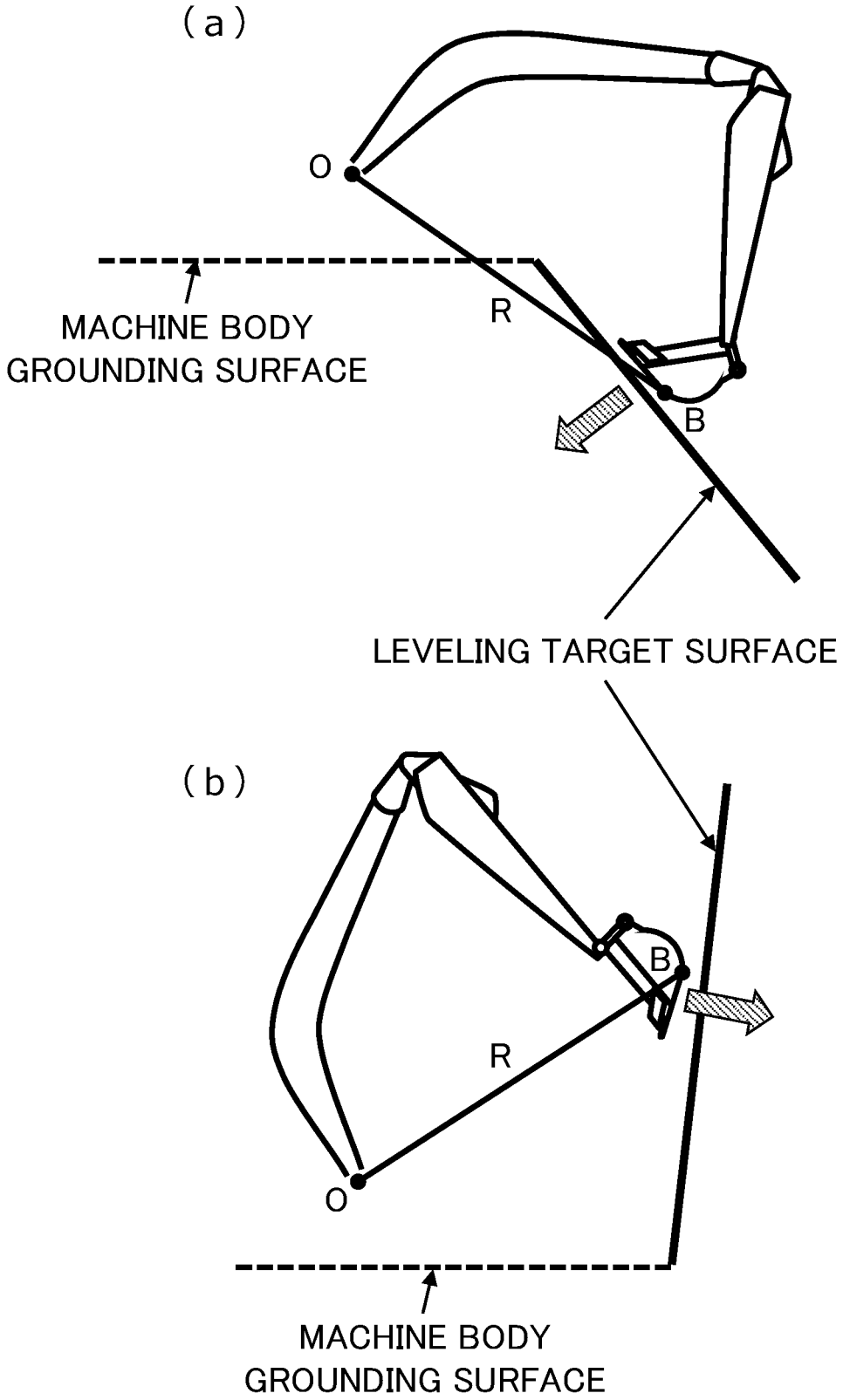
FIG. 5 depicts diagrams of the front distance when a machine body grounding surface and a leveling target surface do not exist in an identical plane.

When a machine body grounding surface of the hydraulic excavator 100 and the leveling target surface exist in an identical plane as depicted in FIG. 4, the front distance R may be approximated with the x-coordinate of the predetermined position B in the back surface. When, in contrast, the machine body grounding surface and the leveling target surface do not exist in the identical plane and the front distance R differs widely from the x-coordinate of the predetermined position B in the back surface as depicted in FIG. 5, preferably the distance between the coordinate origin O and the predetermined position B in the back surface is basically defined as the front distance R.

The bucket target velocity determination section 18*a*2 calculates the target velocity of the bucket 6 during the compaction work on the basis of the front distance R calculated by the bucket position calculation section 18*a*1. The bucket target velocity is defined so as to take a positive value when the bucket 6 approaches the leveling target surface.

An example of calculation performed by the bucket target velocity determination section 18*a*2 will be described with reference to FIG. 6.

Figure 6:
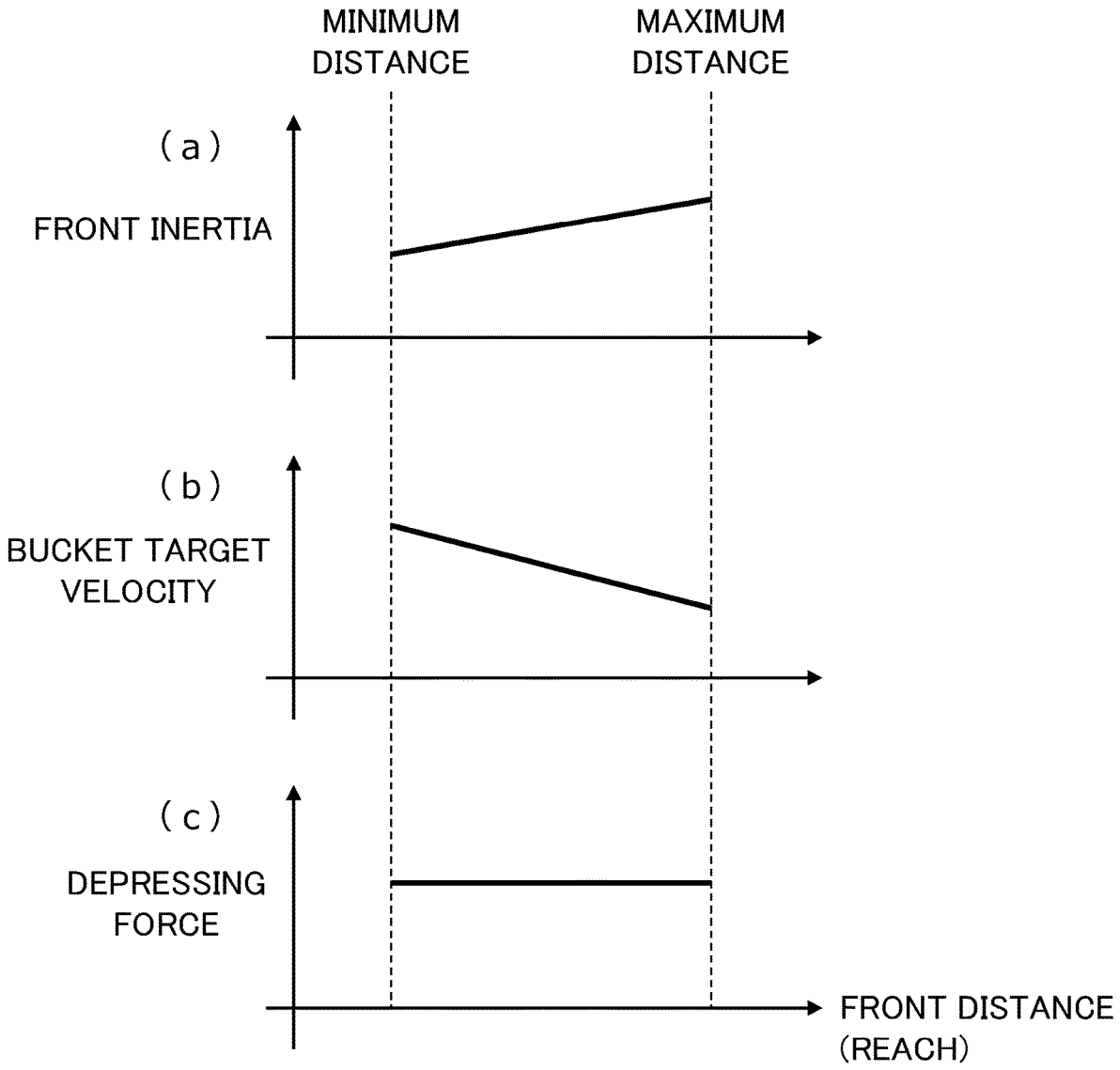
FIG. 6 depicts graphs of an example of results of calculation performed by a bucket target velocity determination section according to the first embodiment.

FIG. 6(*a*) depicts front inertia corresponding to the front distance R and FIG. 6(*b*) depicts the bucket target velocity calculated by the bucket target velocity determination section 18*a*2. FIG. 6(*c*) depicts a depressing force generated when the velocity of the bucket 6 is caused to match the bucket target velocity of FIG. 6(*b*) with respect to the front inertia of FIG. 6(*a*).

The front distance R relative to the front inertia depicted in FIG. 6(*a*) varies according to the angles of the boom 4, the arm 5, and the bucket 6. A trend is, however, maintained in which the front inertia increases with increasing values of the front distance R.

The bucket target velocity determination section 18*a*2 is characterized by decreasing the bucket target velocity with increasing values of the front distance R, specifically, with increasing the front inertia, to thereby make constant the depressing force that is represented by a unit of a physical quantity representing a product of the front inertia and the bucket velocity regardless of the front distance R.

The control changeover section 18*a*3 enables or disables the present control according to an output from a compaction work determination section 18*f*, which determines whether or not compaction work is in progress. The compaction work determination section 18*f* may enable the control at any timing through an operation by the operator or may determine the changeover automatically using a specific work condition. Another possible configuration is such that a signal of a leveling work support control section 18*e* is enabled when the compaction work support is terminated (placing the control changeover section 18*a*3 in a disabled position).

The leveling work support control section 18*e* includes a front target velocity determination section 18*e*1. The front target velocity determination section 18*e*1 determines the target velocity of each of the boom 4, the arm 5, and the bucket 6 such that the predetermined position (e.g., claw tip position) of the bucket 6 obtained by the bucket position calculation section 18*a*1 does not reach below the leveling target surface obtained by the leveling target surface setting section 18*d*. Details of the front target velocity determination section 18*e*1 fall outside the scope of the present invention and descriptions therefor will be omitted.

The operation instruction display control section 18*b* includes an operation instruction determination section 18*b*1 and an operation instruction display section 18*b*2.

The operation instruction determination section 18*b*1 calculates, during leveling work, a lever operation that achieves each of the target velocities of the boom 4, the arm 5, and the bucket 6 determined by the front target velocity determination section 18*e*1. During compaction work, the operation instruction determination section 18*b*1 calculates a lever operation that achieves the bucket target velocity calculated by the bucket target velocity determination section 18*a*2.

Figure 7:
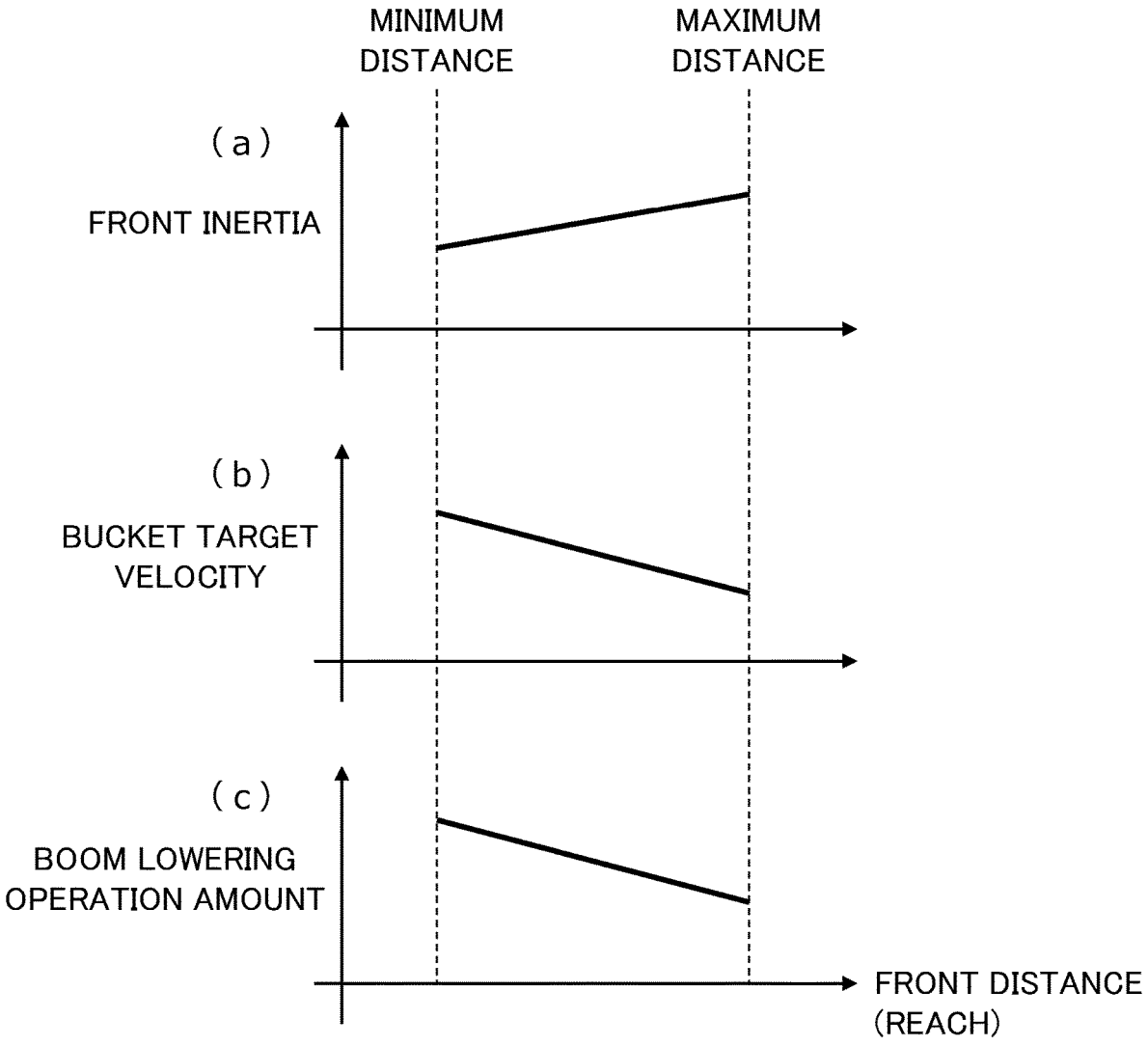
FIG. 7 depicts graphs of an example of results of calculation performed by an operation instruction determination section according to the first embodiment.

FIG. 7 depicts an example of calculation performed by the operation instruction determination section 18*b*1 during compaction work, in which the bucket 6 is caused to hit against the leveling surface through only a boom lowering operation. FIGS. 7(*a*) and 7(*b*) are graphs depicting, as with FIGS. 6(*a*) and 6(*b*), changes in the front inertia and the bucket target velocity corresponding to the front distance R. The operation instruction determination section 18*b*1 determines, as depicted in FIG. 7(*c*), a boom lowering operation amount (e.g., a lever inclination amount) so as to achieve the bucket target velocity of FIG. 7(*b*).

The operation instruction display section 18*b*2 performs information processing for displaying on the monitor in the cab 9 the details of the operation (e.g., lever operation amount) determined by the operation instruction determination section 18*b*1 and transmitting the instruction by voice through a speaker in the cab 9.

The hydraulic system control section 18*c* includes a control amount determination section 18*c*1 and a work implement velocity adjustment section 18*c*2.

During the leveling work, the control amount determination section 18*c*1 calculates target values of target velocities of the cylinders 4*a* to 6*a* such that the target velocities of the boom 4, the arm 5, and the bucket 6 determined by the front target velocity determination section 18*e*1 are achieved, and target values of amounts of hydraulic fluid to be supplied to the cylinders 4*a* and the like for achieving the cylinder target velocities. During the compaction work, the control amount determination section 18*c*1 calculates target values of target velocities of the cylinders 4*a* to 6*a* such that the bucket target velocity calculated by the bucket target velocity determination section 18*a*2 is achieved, and target values of amounts of hydraulic fluid to be supplied to the cylinders for achieving the cylinder target velocities.

The work implement velocity adjustment section 18*c*2 controls the hydraulic pump unit 7 and the control valve 8 to thereby achieve the target values of the amounts of hydraulic fluid to be supplied to the cylinders 4*a* to 6*a* calculated by the control amount determination section 18*c*1.

The hydraulic system control section 18*c* enables any desired bucket target velocity to be achieved regardless of the lever operation amount by the operator.

Effects achieved by the hydraulic excavator 100 according to the present embodiment, having configurations as described above, will be described through a comparison with the known art.

Figure 8:
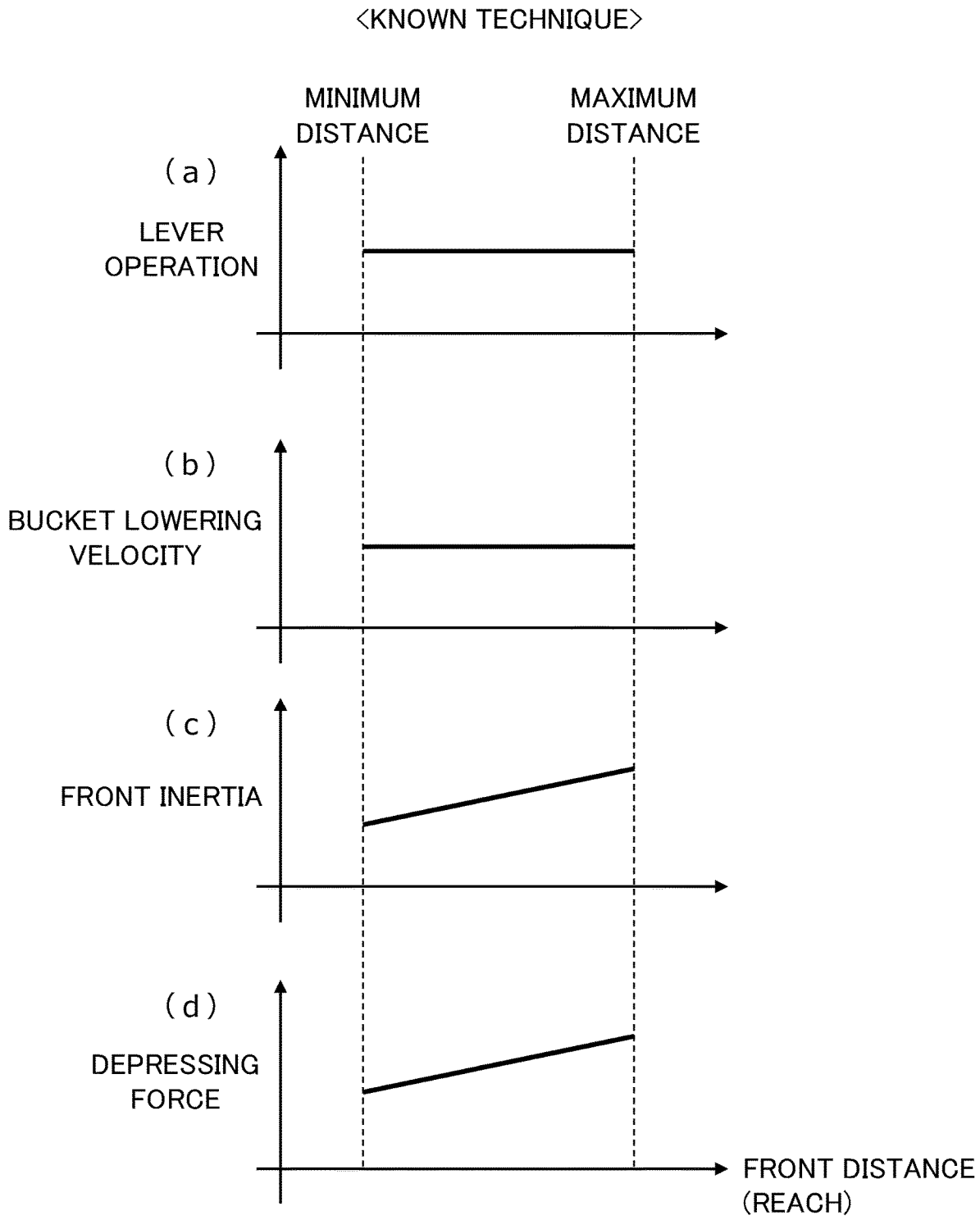
FIG. 8 depicts graphs of changes in the depressing force with respect to the front distance when the known technique is applied.

FIG. 8 depicts graphs of changes in the depressing force with respect to the front distance R when control of the known technique (disclosed in Patent Document 2), in which the bucket velocity with respect to the boom operation amount remains constant regardless of the reach (front distance R) of the front work implement, is applied. FIG. 8 depicts how the bucket lowering velocity, the front inertia, and the depressing force change with the front distance R when the boom lowering operation is performed with a predetermined lever operation amount (e.g., lever stroke 50%) regardless of the front distance R.

With the technique disclosed in Patent Document 2, having the predetermined lever operation amount allows the bucket lowering velocity to remain constant regardless of the front distance R. The depressing force is defined as the product of the bucket lowering velocity and the front inertia. Because the front inertia increases according to the front distance R, the depressing force increases with increasing values of the front distance R when the bucket lowering velocity remains constant. Thus, with the technique disclosed in Patent Document 2, the operator needs to adjust the lever operation amount according to the front distance R in order to make the depressing force uniform, and a high level of expertise is, therefore, required to make the depressing force uniform.

In contrast, with the hydraulic excavator 100 in the present embodiment, during the compaction work, the bucket target velocity is determined such that the velocity with which the bucket 6 approaches the leveling target surface decreases with increasing values of the front distance R and the operator is notified of details of the operations of the operation lever devices 9*a* and 9*b* for achieving the bucket target velocity or drive of the hydraulic actuators 4*a* to 6*a* is controlled so as to achieve the bucket target velocity. The operator thereby can make the depressing force of the bucket 6 uniform during the compaction work without the need to perform complicated operations.

Second Embodiment

A hydraulic excavator 100 according to a second embodiment of the present invention will be described with reference to FIGS. 9 through 11.

When a front work implement 1 is jerked on an unsteady site, as on soft earth, a machine body (an upper swing structure 2 and a lower track structure 3) of the hydraulic excavator 100 oscillates in a pitch direction as the front work implement 1 rotates.

Changes in the depressing force when the machine body oscillates in the pitch direction will be described with reference to FIG. 9.

Figure 9:
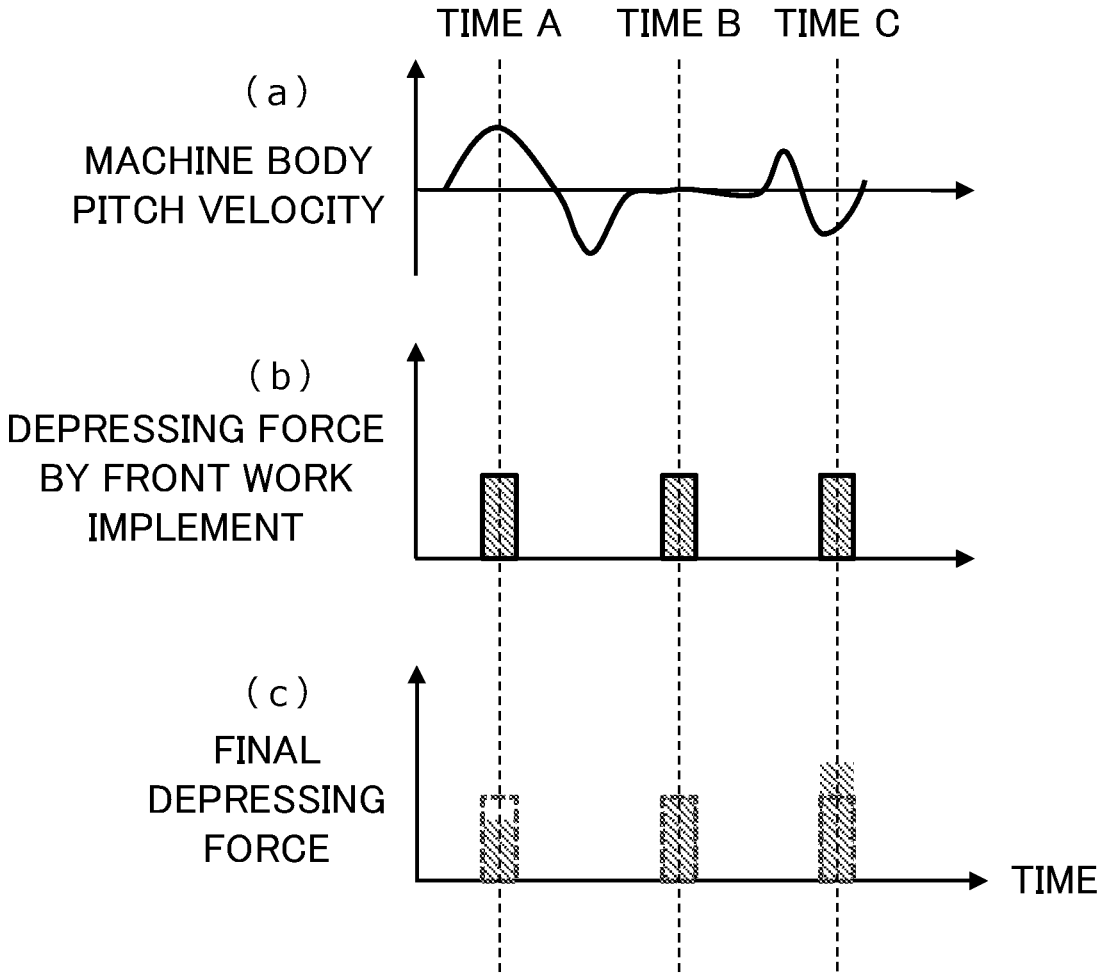
FIG. 9 depicts graphs of an example of changes in the depressing force when compaction work is performed under a condition in which the machine body of the hydraulic excavator oscillates in a pitch direction.

FIG. 9(*a*) denotes the pitch velocity of the machine body, indicating that the velocity is in a direction in which a machine body anterior portion leaves the ground when the machine body pitch velocity is positive. FIG. 9(*b*) denotes the depressing force by the front work implement 1. It is noted that similar control is performed for the front work implement 1 as in the first embodiment and the depressing force by the front work implement 1 is assumed to be uniform. A final depressing force acting on the leveling ground is, however, the depressing force by the front work implement 1, to which an effect from a machine body weight due to a pitch oscillation of the machine body is added, as denoted in FIG. 9(*c*). It is noted that, in FIG. 9(*c*), the depressing force by the front work implement 1 denoted in FIG. 9(*b*) is indicated by the dotted line.

Because the machine body anterior portion has a velocity acting in the direction of leaving the ground at a time A, the final depressing force is smaller than the depressing force by the front work implement 1. At a time B, the machine body is stationary and the depressing force by the front work implement 1 is directly the final depressing force. At a time C, because the machine body anterior portion has a velocity acting in the direction in which the machine body anterior portion approaches the ground, the final depressing force is greater than the depressing force by the front work implement 1.

In the first embodiment, the depressing force of the bucket 6 may be non-uniform when the compaction work is performed under a condition in which the machine body oscillates in the pitch direction. The present embodiment provides a solution to the foregoing problem.

Figure 10:
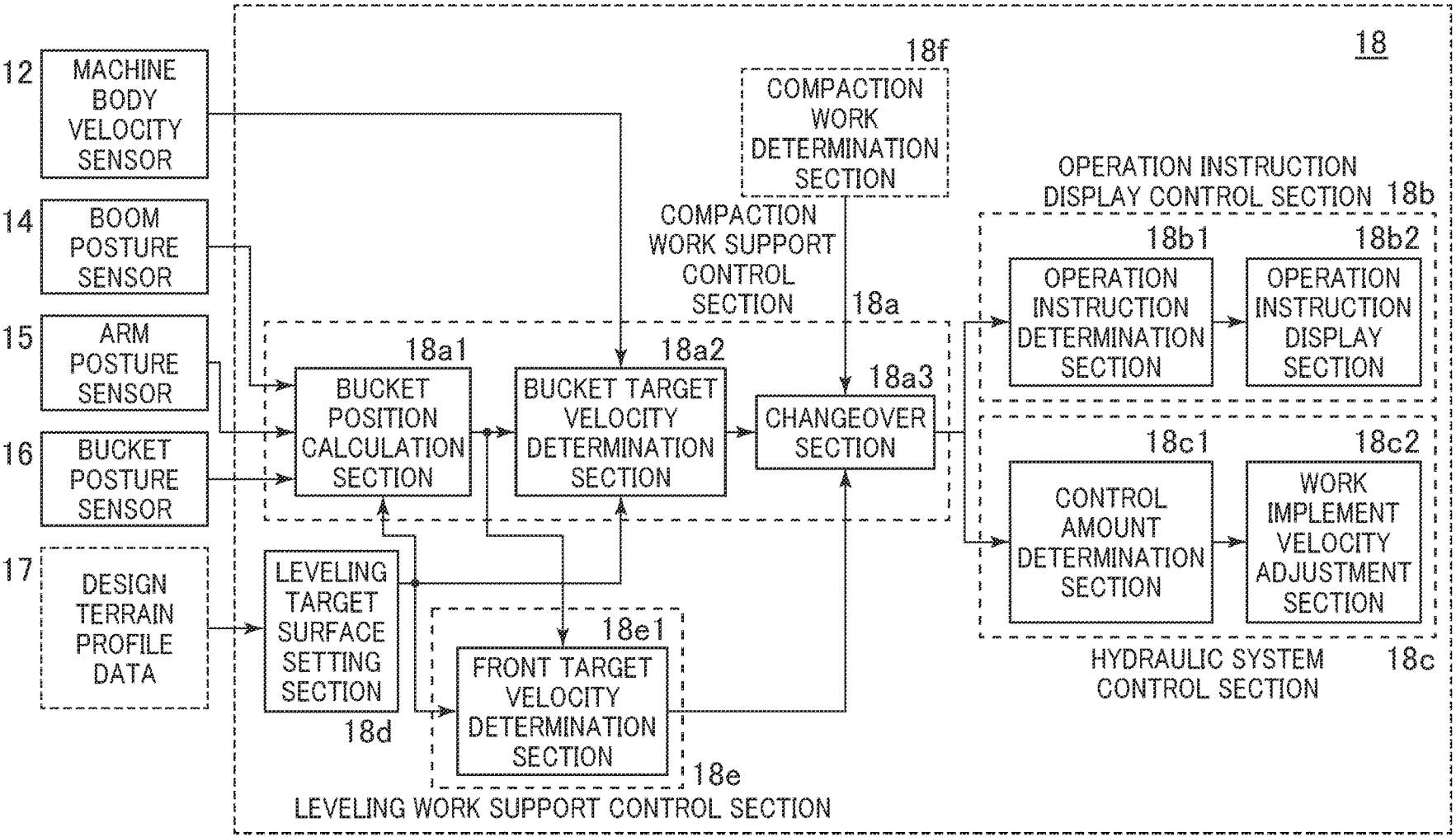
FIG. 10 is a detailed functional block diagram of a controller according to second and third embodiments.

FIG. 10 is a functional block diagram depicting detailed processing functions of a controller 18 according to the present embodiment. The present embodiment differs from the first embodiment (depicted in FIG. 3) in that a bucket target velocity determination section 18*a*2 uses velocity information in the pitch direction of the machine body sensed by a machine body velocity sensor (machine body inertial measurement unit) 12.

An example of calculation performed by the bucket target velocity determination section 18*a*2 according to the present embodiment will be described with reference to FIG. 11.

Figure 11:
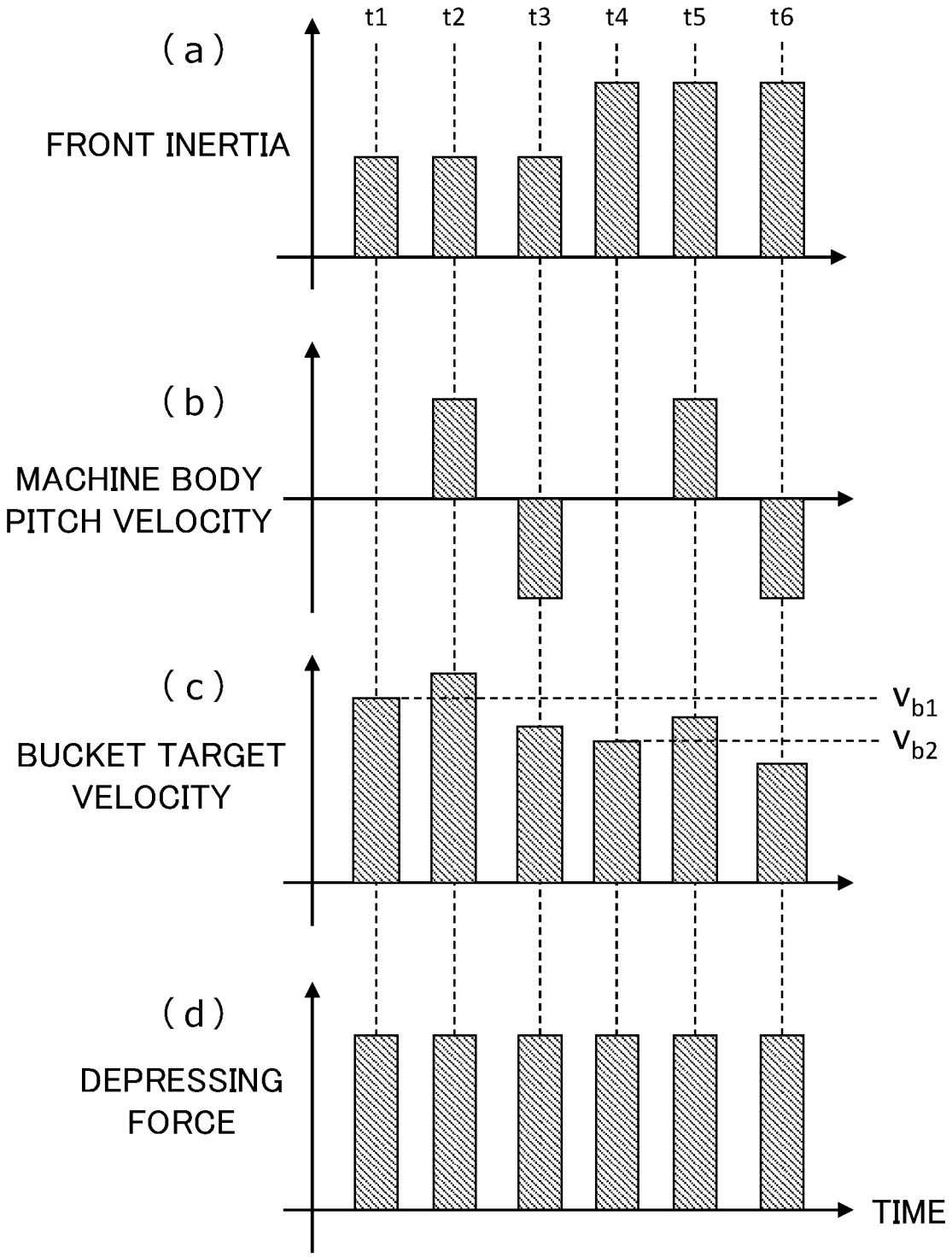
FIG. 11 depicts graphs of an example of results of calculation performed by a bucket target velocity determination section according to the second embodiment.

FIG. 11(*a*) denotes the front inertia at different times. FIG. 11(*a*) indicates that, at times t1 to t3, the front work implement 1 maintains identical posture, changes the posture at a time between the time t3 and the time t4, and maintains identical posture again at times t4 to t6.

FIG. 11(*b*) denotes pitch velocities of the machine body at different times. FIG. 11(*b*) indicates that the machine body is stationary at times t1 and t4, the machine body anterior portion is raised from the ground at times t2 and t5, and the machine body anterior portion approaches the ground at times t3 and t6.

FIG. 11(*c*) denotes bucket target velocities at different times, calculated by the bucket target velocity determination section 18*a*2.

At the time t1, the front inertia is small and the machine body is stationary. The bucket target velocity calculated at this time is denoted as vb1 and a comparison is made among the bucket target velocities at different times.

At the time t2, the front inertia remains the same, unchanged from the time t1. Because the machine body anterior portion has a velocity in the direction in which the machine body anterior portion is raised from the ground, however, the depressing force is maintained by making the bucket target velocity greater than vb1.

At the time t3, the front inertia remains the same, unchanged from the time t1. Because the machine body anterior portion has a velocity in the direction in which the machine body anterior portion approaches the ground, however, the depressing force is maintained by making the bucket target velocity smaller than vb1.

At the time t4, the machine body is stationary although the front inertia is greater than at the time t1. Thus, the depressing force is maintained by setting the bucket target velocity to vb2, which is smaller than vb1.

At the time t5, the machine body anterior portion has a velocity in the direction in which the machine body anterior portion is raised from the ground, although the front inertia remains the same, unchanged from the time t4. Thus, the depressing force is maintained by making the bucket target velocity greater than vb2. It is noted that, although the bucket target velocity is smaller than vb1 at the time t5 in FIG. 11(*c*), the bucket target velocity at the time t5 may become greater than vb1 depending on the magnitude of the front inertia and the machine body pitch velocity.

At the time t6, the machine body anterior portion has a velocity in the direction in which the machine body anterior portion approaches the ground, although the front inertia remains the same, unchanged from the time t4. Thus, the depressing force is maintained by making the bucket target velocity smaller than vb2. The bucket target velocity is the smallest with a combination of the time t6.

While FIG. 11 treats discrete behavior at each of the different times t1 to t6 for ease of explanation, the control may be performed in the same manner also when the work is continuously performed.

A large depressing force is generated particularly when a cycle of the machine body pitch velocity is synchronized with the bucket velocity. This is effective for obtaining the depressing force in posture that yields small front inertia.

It should, however, be noted that synchronizing the cycle of the machine body pitch velocity with the bucket velocity in posture that yields large front inertia generates an excessive depressing force. In this case, the equivalent depressing force may not be able to be generated even when the bucket velocity is maximized in the posture yielding the small front inertia. Thus, when the front distance R is great, preferably the bucket target velocity is determined so as not to allow the cycle of the machine body pitch velocity to be synchronized with the bucket velocity.

The cycle of the machine body pitch velocity can be determined by recording sensed values of the machine body velocity sensor 12 for a predetermined period of time and analyzing the recorded data.

The hydraulic excavator 100 according to the present embodiment, having configurations as described above, can achieve effects similar to the effects achieved by the first embodiment.

Additionally, the target velocity of the bucket 6, which is established to correspond to the front distance R, is corrected according to the machine body pitch velocity. Thus, the depressing force of the bucket 6 can be made uniform even when the compaction work is performed while the machine body oscillates in the pitch direction.

Third Embodiment

A hydraulic excavator 100 according to a third embodiment of the present invention will be described with reference to FIGS. 12 through 14.

An extension/contraction velocity of each of cylinders 4*a* to 6*a* of the hydraulic excavator 100 has an upper limit. The bucket velocity thus has a physical upper limit. The second embodiment does not consider this upper limit value in calculating the bucket target velocity. The present embodiment enables support for effective compaction work in which the upper limit value of the bucket velocity is taken into consideration.

A controller 18 according to the present embodiment has a configuration identical to the configuration in the second embodiment (depicted in FIG. 10). Details of calculation performed by a bucket target velocity determination section 18*a*2 are, however, different.

An example of calculation performed by the bucket target velocity determination section 18*a*2 according to the present embodiment will be described with reference to FIG. 12.

At a time t7, behavior is indicated in which the front inertia is a maximum Imax and the velocity with which the machine body anterior portion approaches the ground is a maximum Mmin ("min" because of a negative value). The depressing force achieved at this time is denoted as F1.

At a time t8, behavior is indicated in which the front inertia is a minimum Imin and the velocity with which the machine body anterior portion approaches the ground is the maximum Mmin. Under the foregoing condition, the depressing force F1 can be maintained only when the bucket velocity is greater than at the time t7. Thus, the depressing force F1 is maintained by setting the bucket target velocity at the time t8 to a maximum value vmax of the bucket velocity to be achieved by the front work implement 1.

At times t9 and t10, the front inertia is a minimum Imin and the machine body is stationary or the machine body anterior portion has a velocity in the direction in which the machine body anterior portion is raised from the ground. Thus, the bucket target velocity required for achieving the depressing force F1 is greater than the maximum value vmax. The front work implement 1 is, however, unable to achieve the bucket velocity greater than the maximum value vmax and thus the depressing force F1 cannot be achieved at the times t9 and t10.

When the bucket target velocity required for achieving the depressing force F1 is greater than the maximum value vmax of the bucket velocity achieved by the front work implement 1 as described above, preferably an operation instruction display control section 18*b* notifies the operator of the deficiency in the depressing force or prompts the operator to increase the number of hits against the ground.

Alternatively, the bucket target velocity may be set to vmin so as to achieve only a minimum depressing force F2, as at a time t11, at which the front inertia and the machine body pitch velocity are identical to those at the time t7. A caution is, however, needed in this case for an increased number of hits against the ground due to the insufficient depressing force, though a satisfactory level of workmanship of a finished surface can be achieved.

Figure 12:
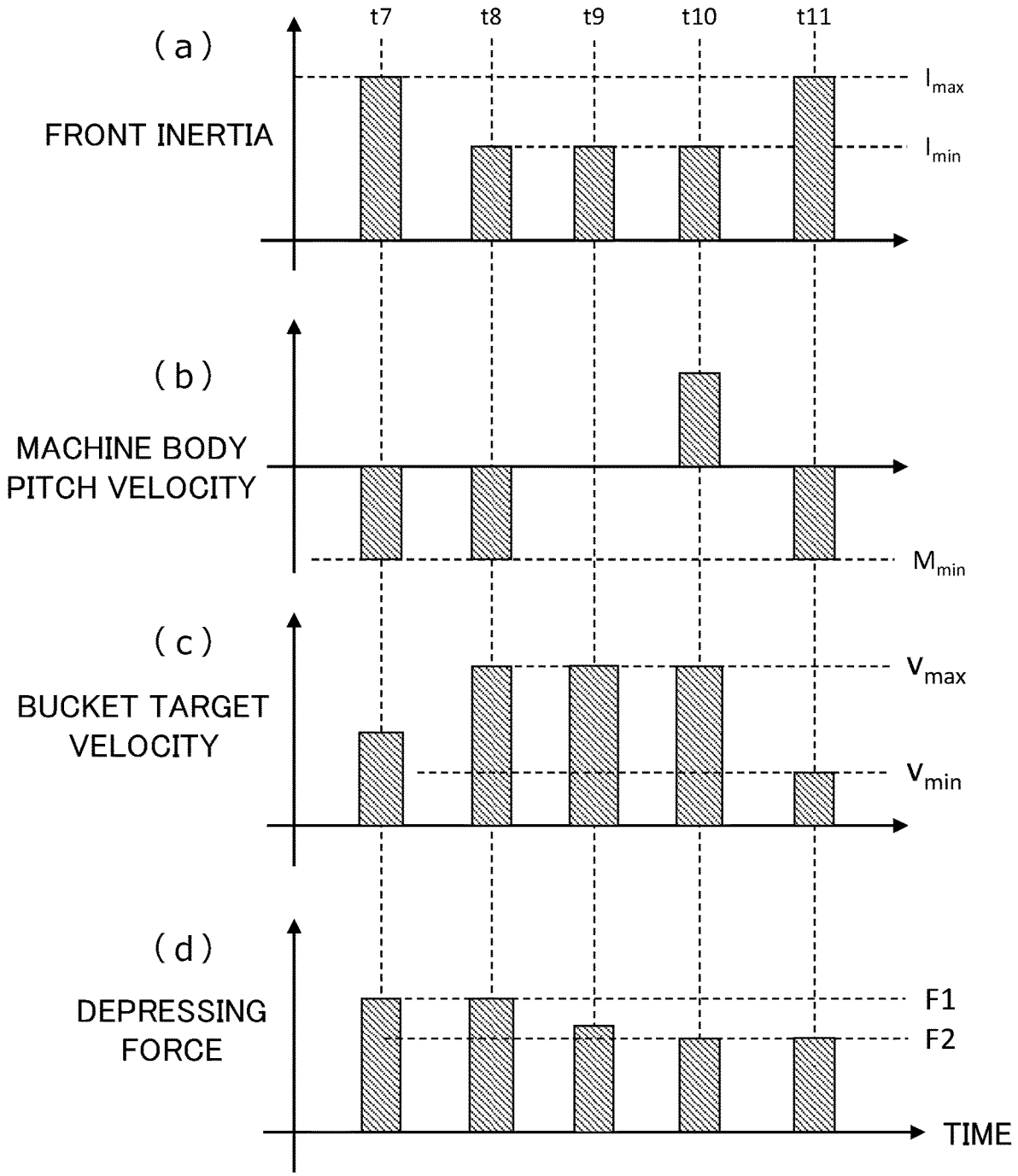
FIG. 12 depicts graphs of an example of results of calculation performed by a bucket target velocity determination section according to the third embodiment.
Figure 13:
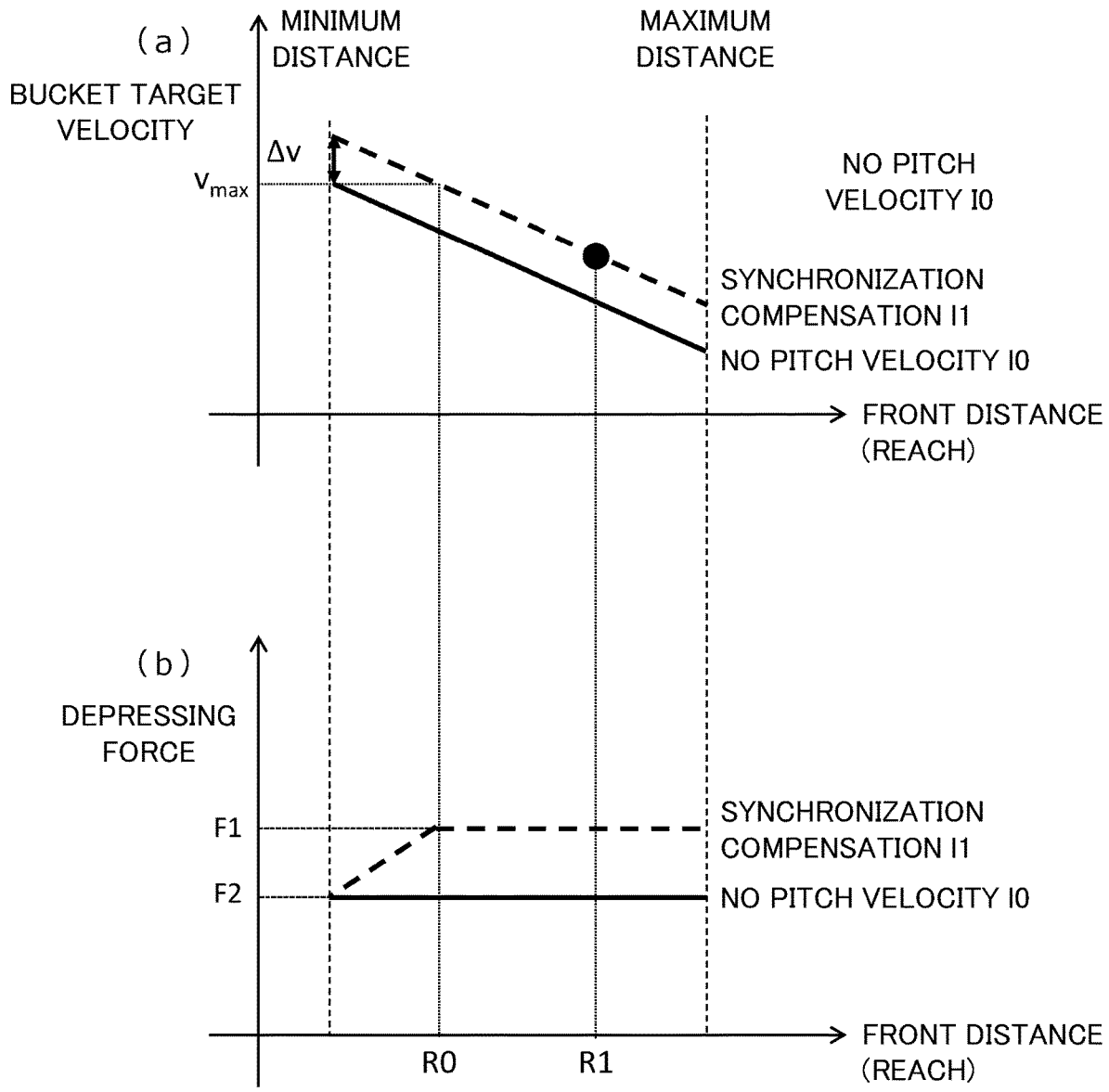
FIG. 13 depicts graphs of changes in the bucket target velocity and the depressing force with respect to the front distance when a machine body pitch velocity is synchronized with the bucket velocity.

To bring the details of the control illustrated in FIG. 12 into a continuous perspective, FIG. 13, in which the front distance R is given on the abscissa, is presented to demonstrate changes in the bucket target velocity and the depressing force with respect to the front distance R when the machine body pitch velocity is 0 (the machine body pitch angle does not change relative to the leveling surface) and when the machine body pitch velocity is synchronized with the bucket velocity in posture in which the front distance R is R1.

FIG. 13(*a*) is a graph depicting changes in the bucket target velocity with respect to the front distance R. When the machine body pitch velocity is 0, a control characteristic is "no pitch velocity I0," in which the bucket target velocity decreases with increasing values of the front distance R as in the first embodiment (demonstrated in FIG. 6(*b*)). When the machine body pitch velocity is synchronized with the bucket velocity, the depressing force to account for the machine body weight is added and the bucket target velocity is increased by Δv so as to compensate for the synchronization compared with the case of no pitch velocity. The bucket target velocity at this time is denoted as "synchronization compensation I1."

FIG. 13(*b*) is a graph depicting changes in the depressing force obtained from the no pitch velocity I0 and the synchronization compensation I1. FIG. 13(*b*) demonstrates that, when the front distance R is greater than R0, the depressing force F1 can be maintained by giving the bucket target velocity that represents the characteristic of the no pitch velocity I0 to which Δv is added. FIG. 13(*b*) further demonstrates that, when the front distance R is smaller than R0, the bucket target velocity needs to be increased to a level greater than the maximum velocity vmax that can be achieved by the hydraulic actuators 4*a* to 6*a* before the depressing force F1 can be maintained. Such a situation defies the maintenance of a predetermined depressing force F1, and a finished surface with high quality, therefore, cannot be produced.

Figure 14:
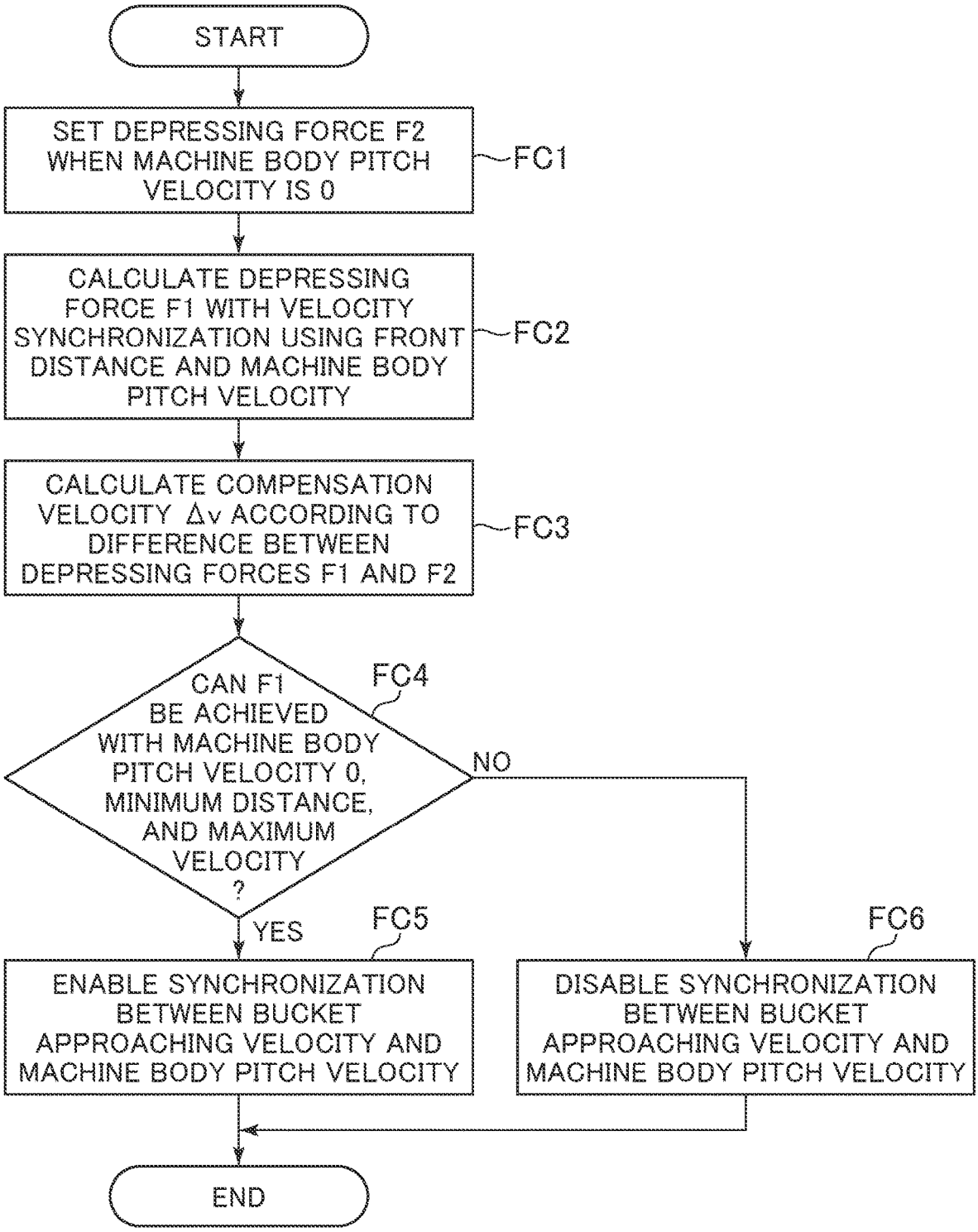
FIG. 14 is a flowchart for control arithmetic operations performed by a controller according to a third embodiment.

FIG. 14 is a flowchart for control arithmetic operations performed for avoiding the above-described situation.

In Step FC1, the depressing force F2 when the machine body pitch velocity is 0 is set. While FIG. 14 indicates that F2 is set in the beginning every time the flowchart is performed, F2 may be set in advance and called.

In Step FC2, the depressing force F1 generated when the bucket velocity is synchronized with the machine body pitch velocity is calculated using the front distance calculated by a bucket position calculation section 18*a*1 and the machine body pitch velocity measured by a machine body velocity sensor 12.

In Step FC3, a difference is found between the depressing forces F1 and F2 calculated in Steps FC1 and FC2, respectively, and an increment Δv in the bucket velocity required for compensating for the difference is calculated.

In Step FC4, a comparison is made between the maximum velocity vmax and a bucket target velocity v2 calculated when the front posture is a minimum distance, specifically, when the front inertia is Imin, under a characteristic that the machine body pitch velocity is 0, specifically, the depressing force F2 is generated, to which the velocity increment Δv calculated in Step FC3 is added (v2+Δv).

When "v2+Δv≤vmax," the depressing force F1 can be achieved and Step FC5 is performed and synchronization is enabled between a bucket approaching velocity and the machine body pitch velocity.

When "v2+Δv>vmax," the depressing force F1 cannot be achieved due to the velocity upper limit. Step FC6 is then performed and the synchronization is not enabled between the bucket approaching velocity and the machine body pitch velocity.

The foregoing control is performed for every arithmetic operation cycle of the controller 18.

The hydraulic excavator 100 according to the present embodiment, having configurations as described above, can achieve effects similar to the effects achieved by the second embodiment.

Additionally, the synchronization between the bucket approaching velocity and the machine body pitch velocity is enabled only when the depressing force F1 can be achieved uniformly over an entire range of the front distance R. Thus, the bucket depressing force can be made uniform even when the compaction work is performed with the front distance R being varied from the minimum distance to the maximum distance.

Fourth Embodiment

A hydraulic excavator according to a fourth embodiment of the present invention will be described with reference to FIG. 15 through FIG. 18.

Figure 15:
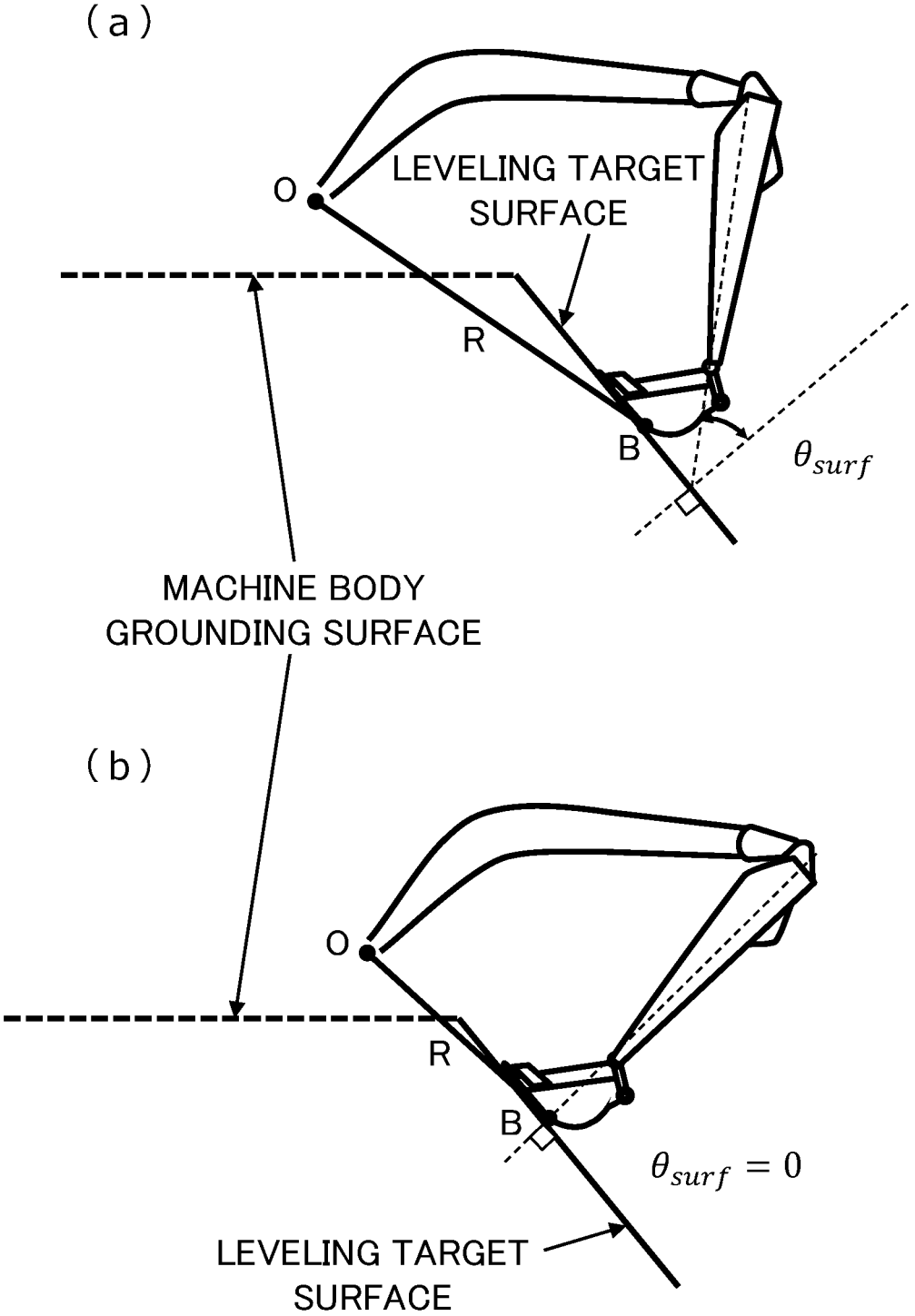
FIG. 15 depicts diagrams of a target surface angle when the machine body grounding surface and the leveling target surface do not exist in an identical plane.

When the machine body grounding surface of the hydraulic excavator 100 differs from the leveling target surface as illustrated in FIG. 15, the compaction work is very often performed in posture in which the arm 5 is folded in. In this case, an angle θsurf formed between a longitudinal direction of the arm 5 and a direction normal direction to the leveling surface (hereinafter referred to as a target surface angle) θsurf is small. This increases an arm load acting on the leveling target surface via the bucket 6. For example, while the front distance R is smaller in the posture of FIG. 15(*b*) than in the posture of FIG. 15(*a*), the smaller target surface angle θsurf provides a greater depressing force. Thus, the depressing force may become non-uniform when the compaction work is performed while the target surface angle θsurf is varied greatly, with the bucket target velocity determined on the basis of only the front distance R as in the first embodiment. The present embodiment provides a solution to the foregoing problem.

Figure 16:
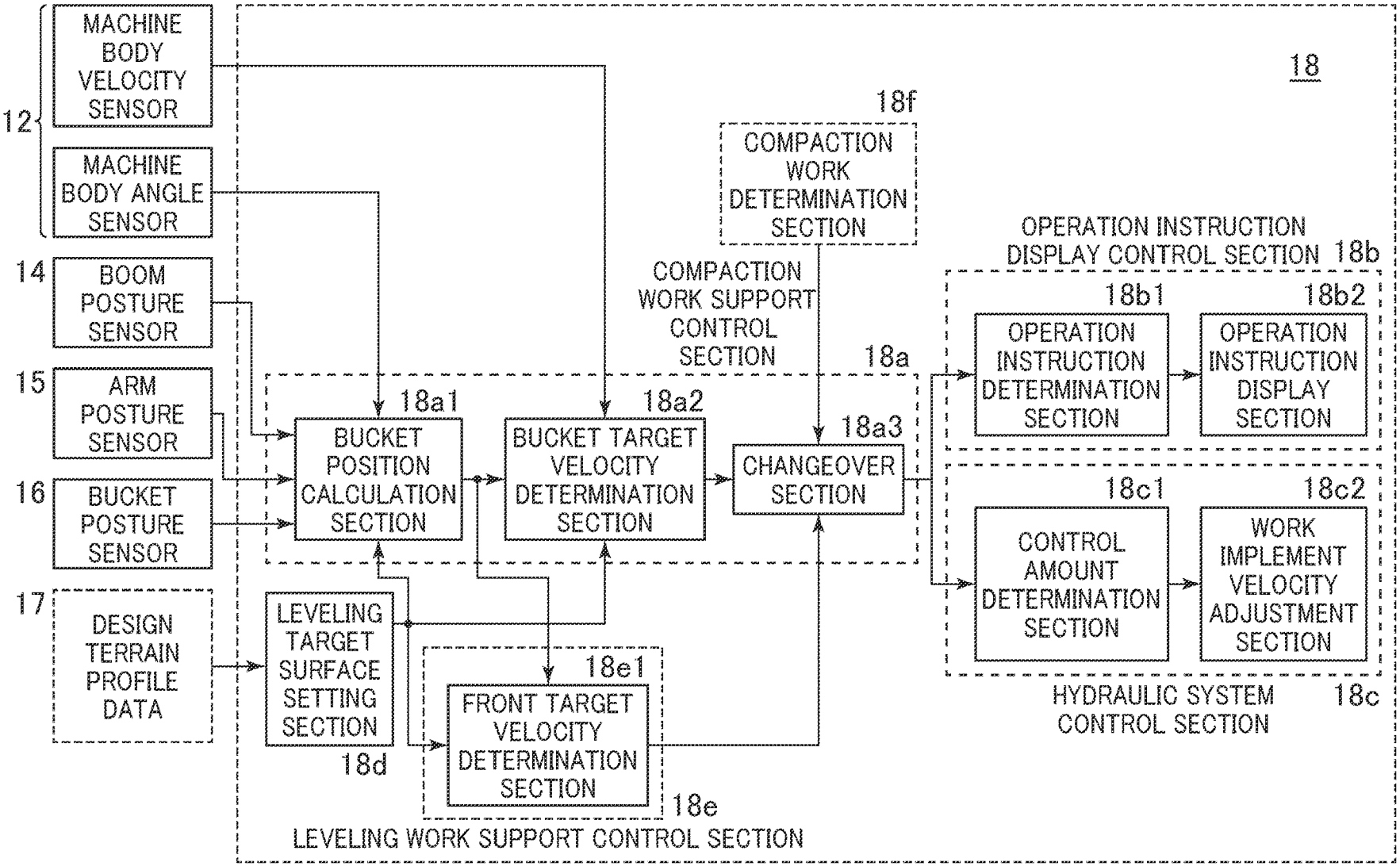
FIG. 16 is a detailed functional block diagram of a controller according to a fourth embodiment.

FIG. 16 is a functional block diagram depicting detailed processing functions of a controller 18 according to the present embodiment. In FIG. 15, a machine body angle sensor is added to the configuration of the controller 18 in the second and third embodiments (denoted in FIG. 10). When the inertial measurement unit is used for the posture sensor, however, the angle information can be sensed from the acceleration in a stationary state. Therefore, the machine body angle sensor can be combined with the machine body velocity sensor to form the machine body inertial measurement unit 12.

A bucket position calculation section 18*a*1 in the present embodiment calculates coordinates of a predetermined position B in a back surface of a bucket 6, including an inclination of the machine body sensed by the machine body angle sensor. More specifically, a rotation matrix considering a machine body angle θbody is applied to the coordinates calculated with the expressions (1) and (2).

The bucket position calculation section 18*a*1 also calculates the angle θsurf (hereinafter referred to as the target surface angle) formed between a straight line that connects the rotational pivot of the boom 4 and the arm 5 with the rotational pivot of the arm 5 and the bucket 6 (the longitudinal direction of the arm 5) and a normal direction to the leveling target surface. The target surface angle θsurf is as indicated in FIGS. 15(*a*) and 15(*b*) and is defined with an absolute value.

A bucket target velocity determination section 18*a*2 in the present embodiment is characterized by using the target surface angle θsurf for calculating the bucket target velocity.

Changes in the depressing force caused by the target surface angle θsurf will be first described with reference to FIG. 16. In FIG. 16(*a*), the front inertia is large because the front distance R calculated by the bucket position calculation section 18*a*1 is large. Because the target surface angle θsurf is also large, however, the arm load cannot be efficiently transmitted to the ground during leveling. In FIG. 16(*b*), because the target surface angle θsurf is 0, although the front distance R is small and thus the front inertia is small, the leveling surface can be efficiently depressed with the arm load and the bucket load.

On the basis of the foregoing, details of arithmetic operations performed by the bucket target velocity determination section 18*a*2 according to the present embodiment will be described with reference to FIG. 17. The machine body pitch velocity is assumed to be 0 in FIG. 17 for ease of explanation. When the machine body pitch velocity is involved, the arithmetic operations may be combined with those of the second and third embodiments.

At a time t12, the front inertia is small and the target surface angle is large. The following described how the bucket target velocity varies from times t13 to t17 with reference to a bucket target velocity vb3 at this time.

At a time t13, the front inertia remains the same as that at the time t12; however, the absolute value of the target surface angle is smaller than at the time t12, and the bucket target velocity is, therefore, smaller than vb3. The target surface angle is further smaller at a time t14 than at the time t13 and the bucket target velocity is also smaller than at the time t13.

At a time t15, while the target surface angle remains the same as that at the time t12, the front inertia is greater than at the time t12. In this case, in accordance with the control of the first embodiment, the bucket target velocity is smaller to correspond to the increment of the front inertia.

At times t16 and t17, only the target surface angle changes, while the front inertia remains the same as that at the time t15. When the front inertia is large, too, the bucket target velocity increases with decreasing target surface angles.

Figure 17:
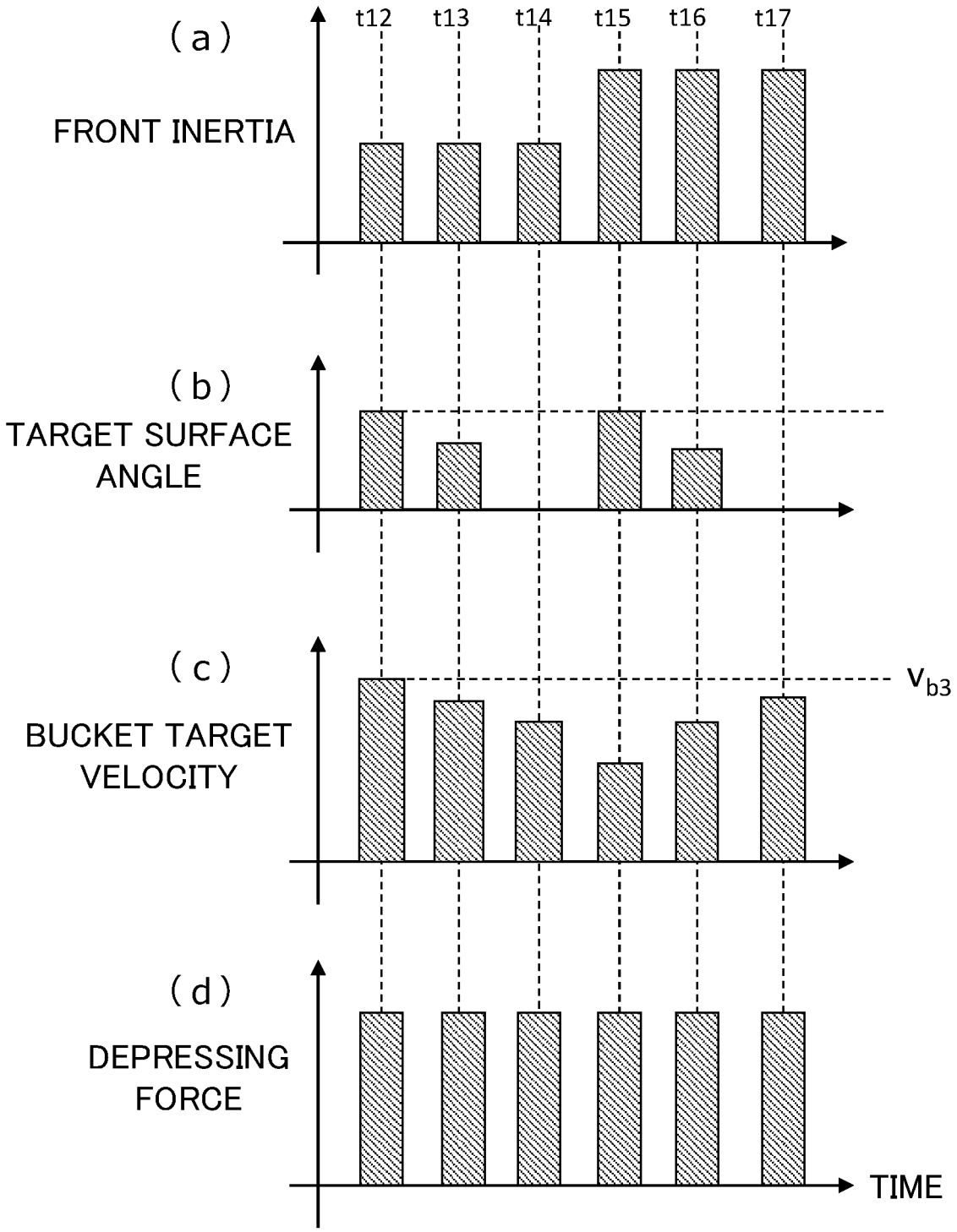
FIG. 17 depicts graphs of an example of results of calculation performed by a bucket target velocity determination section according to the fourth embodiment.
Figure 18:
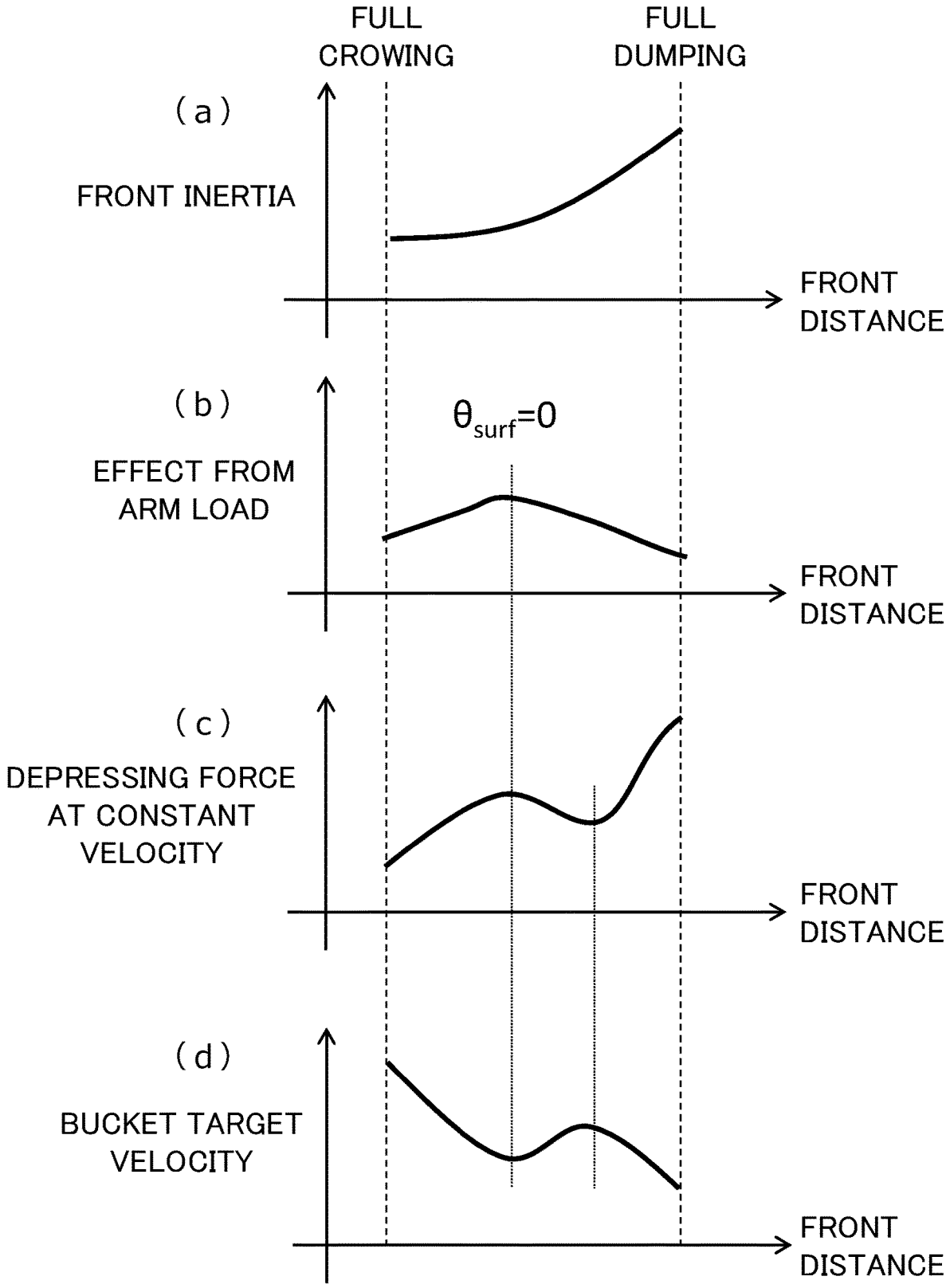
FIG. 18 depicts graphs of changes in the bucket target velocity with respect to the front distance in the fourth embodiment.

To bring the details of the control illustrated in FIG. 17 into a continuous perspective, FIG. 18 is presented to demonstrate changes in the bucket target velocity with the front distance R given on the abscissa, using the compaction work for the leveling target surface illustrated in FIG. 13 as an example. It is noted that FIG. 18 pertains only to a case in which the arm 5 is changed from a folded-in posture (full crowding) to an extended posture (full dumping) for ease of explanation.

FIG. 18(*a*) depicts changes in the front inertia with the front distance R. It should be noted that a moment of inertia is proportional to a square of distance with respect to the rotational axis (the boom foot pin for the hydraulic excavator 100) and is thus a curve (in FIGS. 6 through 8, the changes are indicated by a linear function for simplification of explanation).

FIG. 18(*b*) depicts changes in effects from the arm load with the front distance R. As depicted in FIG. 13(*b*), the effect from the arm load is the greatest when θsurf is 0 and diminishes with positions away from the posture.

FIG. 18(*c*) depicts changes in the depressing force when the bucket 6 is hit with a constant velocity regardless of the front distance R. Because the depressing force is affected by both the front inertia and the arm load, FIG. 18(*c*) may be given by a form of a product of FIGS. 18(*a*) and 18(*b*).

FIG. 18(*d*) depicts changes in the bucket target velocity calculated by the bucket target velocity determination section 18*a*2 of the present invention. The present invention is intended to achieve a constant depressing force regardless of the front distance R through calculation such that the increase and decrease in the bucket target velocity is reversed from the increase and decrease in a term affecting the changes in the depressing force. The present invention is thus characterized by the form of FIG. 18(*d*) that is reversed from FIG. 18(*c*).

The hydraulic excavator 100 according to the present embodiment, having configurations as described above, can achieve effects similar to the effects achieved by the first embodiment.

Additionally, the target velocity of the bucket 6 determined according to the front distance R is corrected such that the velocity at which the bucket 6 approaches the leveling target surface decreases with the angle (target surface angle) θsurf formed between the longitudinal direction of the arm 5 and the normal direction to the leveling target surface approaching 0. The foregoing approach enables the depressing force of the bucket 6 to be uniform even when the compaction work is performed through changing the target surface angle θsurf greatly.

It should be noted that the present invention is not limited to the above-described embodiments and may include various modifications. For example, the entire detailed configuration of the embodiments described above for ease of understanding of the present invention is not always necessary to embody the present invention. The configuration of each embodiment may additionally include another configuration, or part of the configuration may be deleted or replaced with another.

DESCRIPTION OF REFERENCE CHARACTERS

1: Front implement (front work implement)
2: Upper swing structure
2*a*: Swing motor (hydraulic actuator)
3: Lower track structure
3*a*: Track motor
4: Boom
4*a*: Boom cylinder (hydraulic actuator)
5: Arm
5*a*: Arm cylinder (hydraulic actuator)
6: Bucket
6*a*: Bucket cylinder (hydraulic actuator)
7: Hydraulic pump unit
8: Control valve
9: Cab
9*a*: Operation lever device (operation device)
9*b*: Operation lever device (operation device)
12: Machine body inertial measurement unit
14: Boom inertial measurement unit (boom posture sensor)
15: Arm inertial measurement unit (arm posture sensor)

16: Bucket inertial measurement unit (bucket posture sensor)
17: Design terrain profile data
18: Controller (controller)
18*a*: Compaction work support control section
18*a*1: Bucket position calculation section
18*a*2: Bucket target velocity determination section
18*a*3: Control changeover section
18*b*: Operation instruction display control section
18*b*1: Operation instruction determination section
18*b*2: Operation instruction display section
18*c*: Hydraulic system control section
18*c*1: Control amount determination section
18*c*2: Work implement velocity adjustment section
18*d*: Leveling target surface setting section
18*e*: Leveling work support control section
18*e*1: Front target velocity determination section
18*f*: Compaction work determination section
100: Hydraulic excavator

The invention claimed is:

1. A construction machine comprising:

a machine body;

an articulated front work implement disposed anterior to the machine body and including a boom, an arm, and a bucket;

a plurality of hydraulic actuators including a boom cylinder that drives the boom, an arm cylinder that drives the arm, and a bucket cylinder that drives the bucket;

an operation device that is operated by an operator to instruct an operation of each of the boom, the arm, and the bucket;

a boom posture sensor that senses a posture of the boom;

an arm posture sensor that senses a posture of the arm;

a bucket posture sensor that senses a posture of the bucket; and a controller that controls drive of the hydraulic actuators in response to an operation of the operation device, the controller configured to perform:

setting a leveling target surface, determining a target velocity of the bucket such that the bucket does not advance further down the leveling target surface, and, during leveling work, notifying the operator of details of an operation of the operation device for achieving the target velocity of the bucket or controlling drive of the hydraulic actuators so as to achieve the target velocity of the bucket, wherein the controller is configured to determine whether or not compaction work is in progress, calculate a front distance that represents a distance between a rotational pivot of the boom and a predetermined position in a back surface of the bucket, determine the target velocity of the bucket such that a velocity with which the bucket approaches the leveling target surface decreases with increasing values of the front distance, and, during the compaction work, notify the operator of details of an operation of the operation device, the details being used for achieving the target velocity of the bucket, or control drive of the hydraulic actuators so as to achieve the target velocity of the bucket.

2. The construction machine according to claim 1, wherein the controller is configured to calculate a target surface angle that represents an angle formed between a longitudinal direction of the arm and a normal direction to the leveling target surface when the bucket contacts the leveling target surface, and correct the target velocity of the bucket, the target velocity of the bucket being determined according to the front distance, such that the velocity with which the bucket approaches the leveling target surface decreases with decreasing values of the target surface angle.

3. The construction machine according to claim 1, further comprising:

a machine body velocity sensor that senses a pitch velocity of the machine body, wherein the controller is configured to correct the target velocity of the bucket, the target velocity being determined according to the front distance, to correspond with the pitch velocity.

4. The construction machine according to claim 3, wherein the controller is configured to notify the operator of deficiency in a depressing force exerted on the leveling target surface when the target velocity of the bucket is greater than a maximum value of the velocity of the bucket to be achieved by the front work implement.

* * * * *